US007712343B2

(12) United States Patent
Smith et al.

(10) Patent No.: US 7,712,343 B2
(45) Date of Patent: May 11, 2010

(54) DEAD LOCKING DEADBOLT

(75) Inventors: Jerry Smith, Littleton, CO (US); Mike Enslow, Milwaukee, WI (US); Dean D. Hacker, Oak Creek, WI (US); John Weber, Thiensville, WI (US); Tim Ebner, Menomonee Falls, WI (US); Jesse Marcelle, Muskego, WI (US)

(73) Assignee: Master Lock Company LLC, Oak Creek, WI (US)

( * ) Notice: Subject to any disclaimer, the term of this patent is extended or adjusted under 35 U.S.C. 154(b) by 727 days.

(21) Appl. No.: 11/218,113

(22) Filed: Sep. 1, 2005

(65) Prior Publication Data

US 2006/0042336 A1 Mar. 2, 2006

Related U.S. Application Data

(60) Provisional application No. 60/606,211, filed on Sep. 1, 2004, provisional application No. 60/593,462, filed on Jan. 17, 2005.

(51) Int. Cl.
*E05B 55/04* (2006.01)
*E05B 13/10* (2006.01)

(52) U.S. Cl. ..... 70/467; 70/483; 70/224; 292/359

(58) Field of Classification Search ..... 70/432, 70/467, 472, 473, 475, 476, 481, 483, 486, 70/487, 224, 149, 381, 190, 471; 292/359
See application file for complete search history.

(56) References Cited

U.S. PATENT DOCUMENTS 804,399 A * 11/1905 Hardenbergh ..... 70/149
1,362,417 A 12/1920 Hammer
RE15,569 E * 4/1923 Ottinger ..... 292/173
1,840,416 A * 1/1932 Scrivener ..... 292/169.15
1,956,388 A * 4/1934 Loeser ..... 70/416
2,289,129 A 7/1942 LaLonde (Continued)

FOREIGN PATENT DOCUMENTS

CN 2152033 U 1/1994

(Continued)

OTHER PUBLICATIONS

"button—Definition from the Merriam-Webster Online Dictionary," http://www.merriam-webster.com/dictionary/button, 2008.*

(Continued)

*Primary Examiner*—Darnell Jayne
*Assistant Examiner*—Alyson M Merlino
(74) *Attorney, Agent, or Firm*—Calfee, Halter & Griswold LLP

(57) ABSTRACT

A deadbolt mechanism including a lock out mechanism that functions to disable the operation of the deadbolt from at least one side of the deadbolt mechanism. The deadbolt mechanism includes a deadbolt, key cylinder, housing, turn knob and a shaft that connects the key cylinder and turn knob. To place the deadbolt mechanism in lock out mode, a release mechanism is actuated and the turn knob is pulled outward away from the door. By pulling the knob outward, the shaft engages a portion of the housing which prevents rotation of the shaft and thereby prevents movement of the deadbolt from the lock-out position.

11 Claims, 17 Drawing Sheets

U.S. PATENT DOCUMENTS

| | | | | | |
|---|---|---|---|---|---|
| 2,297,711 | A | | 10/1942 | LaLonde | |
| 2,435,634 | A | * | 2/1948 | George et al. | 70/129 |
| 2,481,099 | A | | 9/1949 | Formo et al. | |
| 2,497,329 | A | | 2/1950 | Smith et al. | |
| 2,653,047 | A | * | 9/1953 | Sultan | 292/359 |
| 2,655,026 | A | * | 10/1953 | Syler | 70/469 |
| 3,512,381 | A | * | 5/1970 | Matsunaga | 70/107 |
| 3,792,885 | A | * | 2/1974 | Giardina et al. | 292/39 |
| 3,815,390 | A | * | 6/1974 | Stoia | 70/134 |
| 3,919,867 | A | * | 11/1975 | Lipschutz et al. | 70/186 |
| 4,047,408 | A | * | 9/1977 | Johns et al. | 70/129 |
| 4,231,244 | A | * | 11/1980 | Krugener et al. | 70/422 |
| 4,438,962 | A | * | 3/1984 | Soloviff et al. | 292/144 |
| 4,709,566 | A | | 12/1987 | Wildrenradt | |
| 4,979,383 | A | | 12/1990 | Tully | |
| 5,058,940 | A | * | 10/1991 | Hart | 292/167 |
| 5,072,976 | A | | 12/1991 | Meszaros | |
| 5,087,090 | A | * | 2/1992 | Humphrey et al. | 292/359 |
| 5,150,592 | A | * | 9/1992 | Lin | 70/190 |
| 5,421,074 | A | | 6/1995 | Moore | |
| 5,657,653 | A | | 8/1997 | Hensley et al. | |
| 5,664,448 | A | * | 9/1997 | Swan et al. | 70/224 |
| 5,901,590 | A | * | 5/1999 | Lai | 70/416 |
| 5,909,919 | A | * | 6/1999 | Wang | 292/359 |
| 5,934,122 | A | | 8/1999 | Edwards et al. | |
| 5,950,467 | A | * | 9/1999 | Dong | 70/467 |
| 6,145,358 | A | * | 11/2000 | Wu | 70/467 |
| 6,351,976 | B1 | * | 3/2002 | Chen | 70/224 |
| 6,516,643 | B1 | * | 2/2003 | Olshausen | 70/337 |
| 6,691,538 | B1 | * | 2/2004 | Yang et al. | 70/370 |
| 6,708,538 | B1 | | 3/2004 | Walby | |
| 6,729,169 | B2 | * | 5/2004 | Moore | 70/472 |
| 6,793,254 | B1 | * | 9/2004 | Galvin | 292/163 |
| 6,912,882 | B1 | * | 7/2005 | Alonso | 70/472 |
| 7,207,199 | B2 | * | 4/2007 | Smith et al. | 70/134 |
| 2002/0166354 | A1 | * | 11/2002 | Moore | 70/134 |
| 2005/0039504 | A1 | * | 2/2005 | Smith et al. | 70/134 |

FOREIGN PATENT DOCUMENTS

| | | | | |
|---|---|---|---|---|
| EP | 1057954 | A1 | * | 12/2000 |
| TW | 0291890 | | | 6/1985 |
| TW | 0365285 | | | 10/1987 |
| TW | 0250139 | | | 8/1993 |
| TW | 497639 | | | 8/2002 |
| TW | 55141 | | | 9/2003 |
| TW | 0550329 | B | | 9/2003 |
| TW | 0580039 | Y | | 3/2004 |
| WO | 84/02157 | A1 | | 6/1984 |
| WO | WO-8402157 | A1 | | 6/1984 |

OTHER PUBLICATIONS

Office Action from Taiwan Patent Application No. 94130213, mailed Aug. 1, 2008 (as reported and translated by the law firm Tsar & Tsai of Taipei, Taiwan).

* cited by examiner

DEAD LOCKING DEADBOLT

CROSS-REFERENCE TO RELATED APPLICATIONS

This non-provisional application claims the benefit of U.S. Provisional Patent Application No. 60/606,211, entitled "Dead Locking Deadbolt," filed Sep. 1, 2004, and U.S. Provisional Application No. 60/593,462, entitled "Dead Locking Deadbolt," filed Jan. 17, 2005.

FIELD OF THE INVENTION

This invention relates to locking devices in general and "lock-out" devices for deadbolts in particular.

BACKGROUND OF THE INVENTION

Bolts or deadbolts are well known devices for locking a door shut for security purposes. In such well-known arrangements, the deadbolt or bolt is mounted in the body of the door and the deadbolt is operated by mechanical operating devices mounted on either side of the door. When the deadbolt is operated to a locked position it typically extends or projects from the side of the door into an opening in the door jam or wall to which the door is mounted. Thus, the deadbolt when operated to an extended position, "bolts" or "locks" the door in a closed position. The mechanical operating devices also can operate to retract the bolt into the side of the door to unlock the deadbolt or bolt.

In typical arrangements, one mechanical device used to operate a deadbolt may be a key cylinder into which a key is inserted. The key then can rotate the cylinder which, in turn, operates the deadbolt through various mechanical linkages. Another mechanical device that may be used to operate a deadbolt includes a knob that can be turned manually that, in turn, operates the deadbolt through various mechanical linkages.

It is known to use a key cylinder and knob device together to operate deadbolts. The key cylinder is normally mounted on the exterior side of the door so that a user can use a unique key to operate and lock the deadbolt from the exterior side of the door. The manual knob is typically mounted on the interior of the door and operates the deadbolt from the interior side of the door without a key. Thus, the user can easily lock and unlock the deadbolt from the interior of the door without using or locating a key.

It is sometimes desirable for users to disable the mechanical device for operating the deadbolt that is mounted on the exterior of the door. This can occur in situations in which the user does not wish to permit a person with a key to operate the deadbolt from the exterior side of the door such as, for example, a landlord/tenant situation in which the tenant does not wish the landlord to enter a rental property. Another important use of this feature is to prevent unauthorized access through the manipulation of the deadbolt by lock "picks" or the like. Mechanisms that disable the operation of a mechanical device used to operate a deadbolt are called "lock-out" devices.

Known lock-out devices for deadbolts are unreliable, difficult and clumsy to use and have safety concerns in that they do not signal to a user when a lock-out mechanism is in operation.

SUMMARY OF THE INVENTION

The invention provides a lock-out device for a locking mechanism that is reliable and simple to use and, in some embodiments, signals to the user that the lock-out mechanism has been activated. The invention may be comprised of a shaft upon which a knob or handle is mounted that has openings or channels in the wall of the shaft. The openings in the shaft correspond to protrusions or protuberances in the shaft housing. To operate the lock-out device, a release mechanism is actuated and the handle or knob may be pulled which pulls the openings in the shaft into interlocking engagement with the protrusions in the shaft housing. As a result, a mechanical member that operates the locking mechanism is restrained, thus resulting in a "lock out" of the deadbolt bolt mechanism. Thus, the deadbolt can not be operated by a key through a key cylinder mounted on the exterior side of the door effecting a lock-out condition. In some embodiments, when the shaft is pulled into a lock-out position, a portion of the shaft becomes visible from the interior-side of the door. In some embodiments the visible portion of the shaft includes an indicator or warning mechanism to signal to the user that the deadbolt is now in lock-out condition.

DESCRIPTION OF THE DRAWINGS

In the accompanying drawings, which are incorporated in and constitute a part of this specification, embodiments of the invention are illustrated, which, together with a general description of the invention given above, and the detailed description given below serve to illustrate the principles of this invention. The drawings and detailed description are not intended to and do not limit the scope of the invention or the claims in any way. Instead, the drawings and detailed description only describe embodiments of the invention and other embodiments of the invention not described are encompassed by the claims.

DETAILED DESCRIPTION

Figure 1:
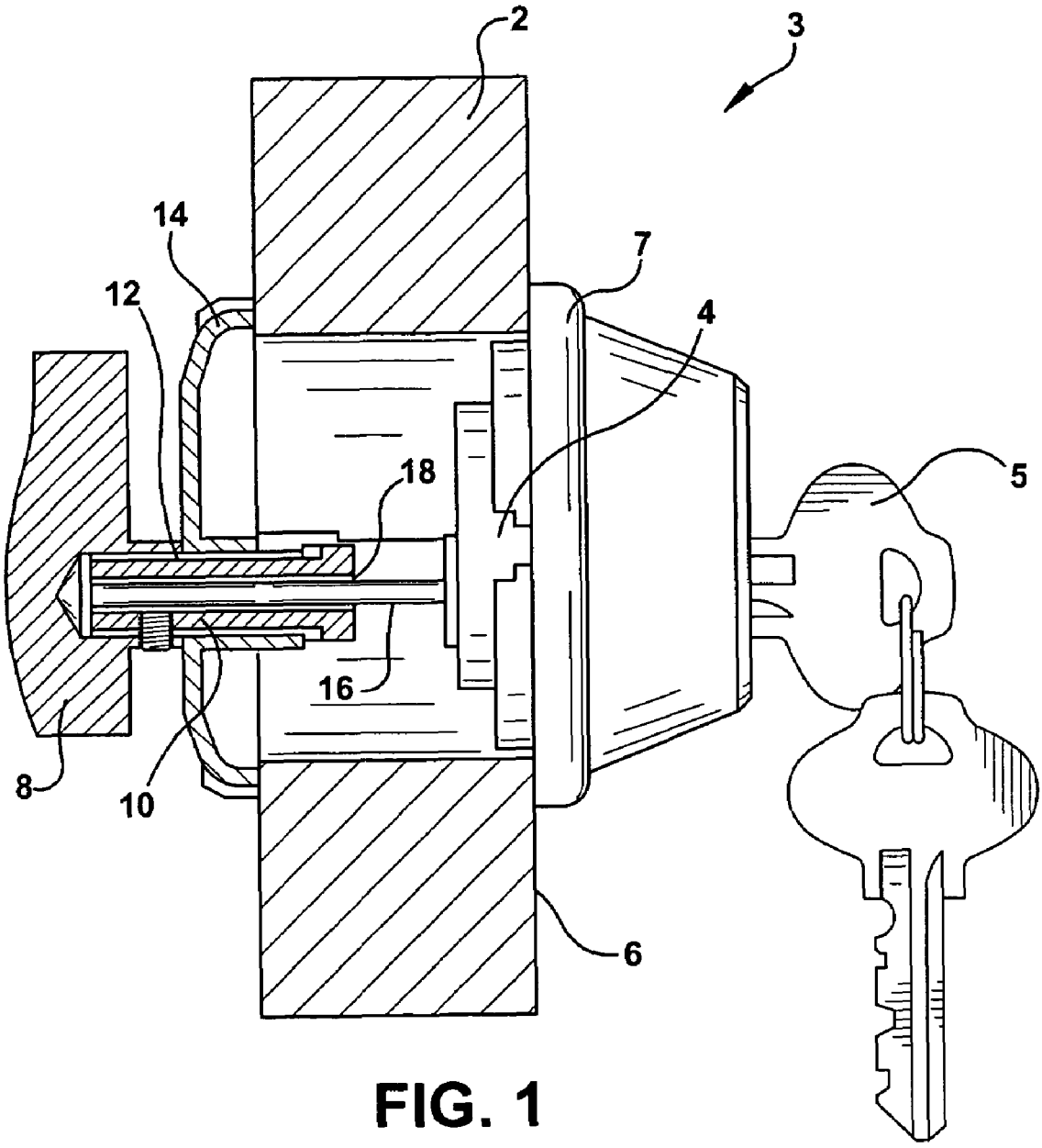
FIG. 1 is a partial cross-sectional view of the deadbolt lock-out mechanism of the present invention.
Figure 2:
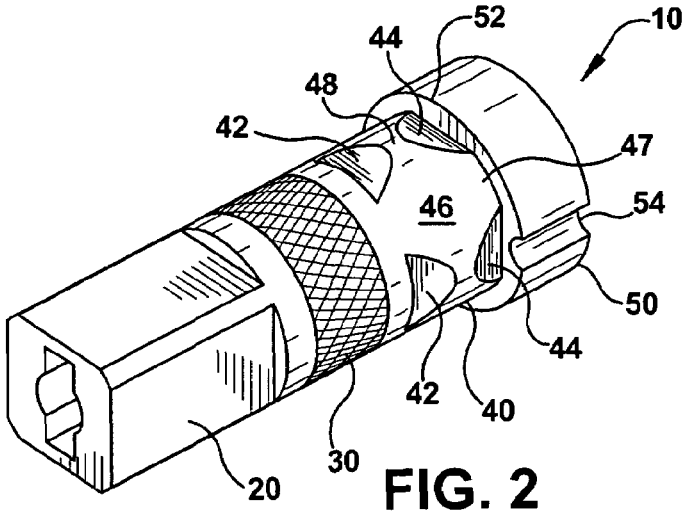
FIG. 2 is a perspective view of the shaft used in the deadbolt lock-out mechanism of the present invention.
Figure 3:
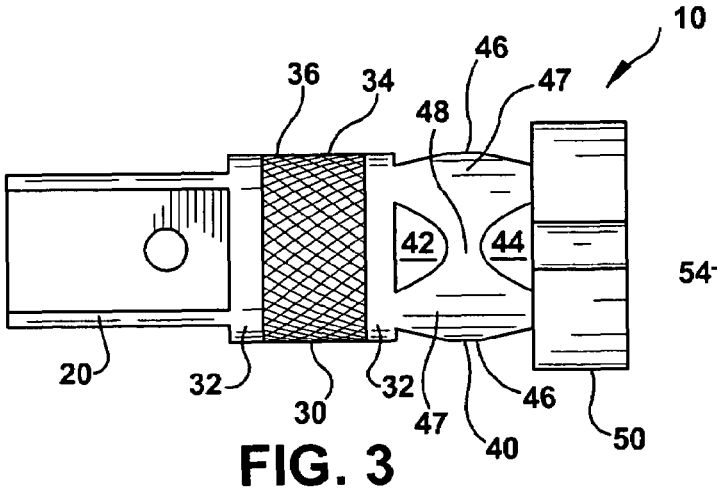
FIG. 3 is a side view of the shaft shown in FIG. 2.
Figure 4:
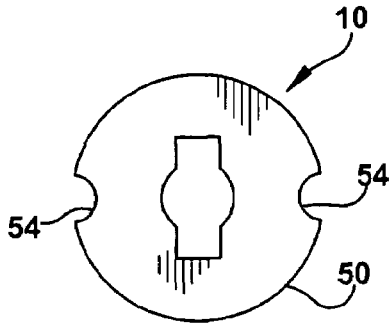
FIG. 4 in an end view of the shaft shown in FIG. 2.
Figure 5:
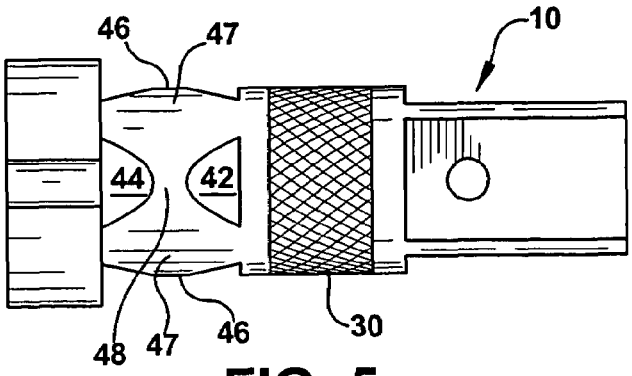
FIG. 5 is a side view of the shaft shown in FIG. 2, opposite from that shown in FIG. 3.
Figure 6:
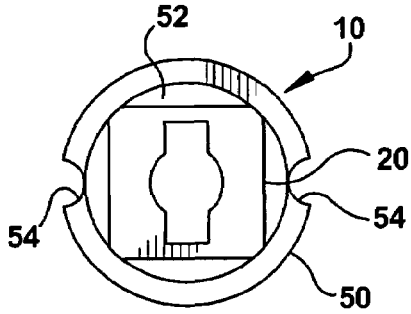
FIG. 6 is a side view of the shaft shown in FIG. 2, opposite from that shown in FIG. 4.

Referring now to FIG. 1, a door 2 including one embodiment of the invention is shown. As can be seen, a deadbolt manipulation mechanism, such as a conventional key cylinder 4 is mounted on one side of the door 2 which permits the deadbolt mechanism 3 to be operated by a key 5. The key cylinder 4 is normally mounted on the exterior side 6 of the door 2 in a protective housing 7. The "exterior-side" of a door is the side which is on the outside wall of a dwelling or building or any space desired to be "locked" from unauthorized entry. However, this invention is not limited to such a configuration and the key cylinder may be mounted on the interior or exterior side of the door. A second deadbolt manipulation mechanism, such as a knob or handle 8 also for operating the deadbolt is mounted on the side of the door opposite the key cylinder 4. The knob or handle 8 is mounted on a shaft 10 further described below. The shaft 10 is, in turn, mounted in an opening 12 in a shaft housing 14.

The key cylinder 4 includes an elongated member 16 sometimes called a "tailpiece" that may be generally rectangular in cross-section, or may be adapted for other configurations. The elongated member 16 is connected to the rear of the key cylinder 4. When the key cylinder 4 is rotated by key 5, member 16 is also rotated. Member 16 is then connected by known mechanical linkages to a bolt or deadbolt (not shown). When member 16 is rotated in one direction the deadbolt is extended into a locked position. When member 16 is rotated in the opposite direction, the deadbolt is retracted into the door 2 into an unlocked position. This type of locking and unlocking action for a deadbolt through a key cylinder 4 is known.

As can be seen in FIG. 1, shaft 10 is hollow in that it has a cavity 18 that extends along its entire length in a horizontal direction when shaft 10 is mounted in shaft housing 14. Member 16 extends from key cylinder 4 into cavity 18 of shaft 10. Thus, when knob 8 is rotated, shaft 10 rotates and then member 16 also rotates. Accordingly, the deadbolt can be operated through use of two different deadbolt manipulation mechanisms, such as handle 8 and key cylinder 4. Thus, both handle 8 and key cylinder 4 may be used to operate the same deadbolt through the rotation of member 16.

Referring now to FIGS. 2-6, shaft 10 is shown. Shaft 10 is comprised of four different subsections along its length. The first subsection is the knob mounting portion 20. Knob mounting portion 20 is generally rectangular or square in cross-section in one embodiment, but could be comprised of any cross-sectional shape. When shaft 10 is mounted in shaft housing 14, knob mounting portion 20 extends from the exterior of shaft housing 14. Knob 8 is then mounted on knob mounting portion 20 by fitting mounting portion 20 into a recess on knob 8. Knob 8 is then secured to mounting portion 20 through the use of known connective methods, such as, for example, a set screw.

The second portion of shaft 10 is signal portion 30. Signal portion 30 is circular in cross-section in one embodiment, but similar to mounting portion 20, its construction is not limited to any particular cross-sectional shape. Signal portion 30 has two boundary walls 32 that form a recessed area 34. An indication mechanism, such as, for example, a colored, circular plastic clip 36 is snap-fit around shaft 10 to fit into recessed area 34 between walls 32. An alternative indication mechanism is direct application of color to the signal portion 30 of the shaft 10. The indication mechanism can be of any color, but a visually distinct color typically used to give alerts or signals such as red, orange or yellow should be used. Alternatively, other indication mechanisms can be used, such as, for example, engravings, knurling, demarcations, recesses, or other physical marking or add on portion that would provide a visible indication to the user that the shaft 10 was pulled-out and the deadbolt mechanism 3 was in lock-out position. Optionally, other indication mechanisms could be used, including electronic mechanisms or audible mechanisms.

The third portion of shaft 10 is camming portion 40. Camming portion 40 has a cross-section that is not typical in that it is comprised of several cam surfaces 42, 44 and 46. Camming portion 40 is essentially comprised of eight different sides. Four sides 47 of camming portion 40 are comprised of four camming surfaces 46. The other four sides 48 are each comprised of two camming surfaces 42 and 44. Sides 47 and sides 48 alternate around the circumference of camming portion 40.

The fourth subsection of shaft 10 is head portion 50. Head portion 50 is generally circular in cross-section in one embodiment, but is not limited in any way to any particular cross-sectional shape. Head portion 50 has a diameter or cross-sectional width that is greater than any of the other three shaft portions 20, 30, 40 such that a ridge or lip 52 is formed between head portion 50 and camming portion 40.

Head portion 50 has two grooves, openings or depressions 54 in its otherwise generally circular perimeter. These depressions 54 are on opposite sides of head portion 50 and are parallel to the horizontal axis of the shaft 10 when mounted in shaft housing 14. Depressions 54 need not be of any particular shape, but in the embodiment shown in FIGS. 2, 3 and 4 they are semi-circular in shape and form a groove-like depression. Depressions 54 could be located anywhere on head portion 50 in addition to the location shown in the embodiment depicted in FIGS. 2-6.

Figure 7:
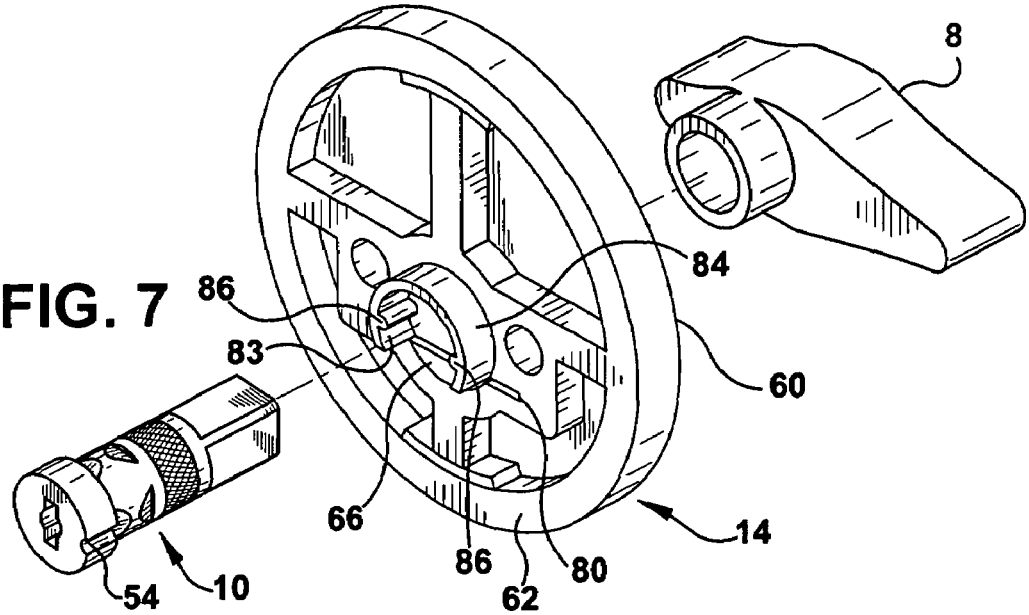
FIG. 7 is an exploded view of the shaft, mounting plate and knob subassembly of the deadbolt locking mechanism of the present invention.
Figure 8:
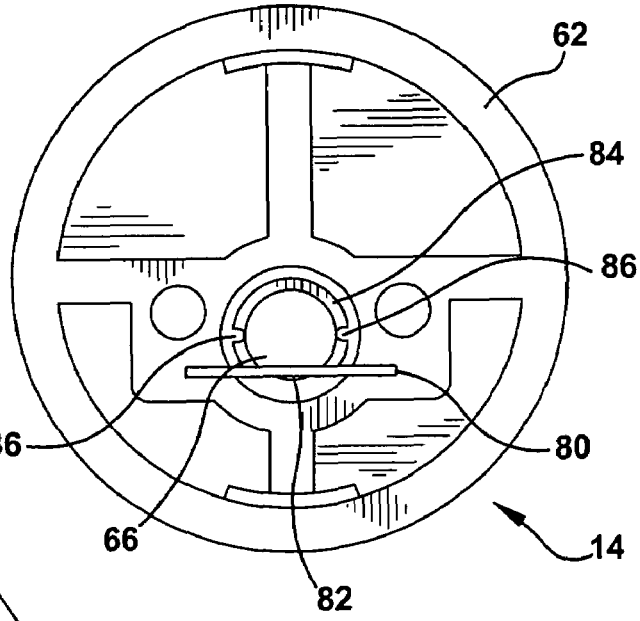
FIG. 8 is a plan view of the mounting plate shown in FIG. 7.
Figure 9:
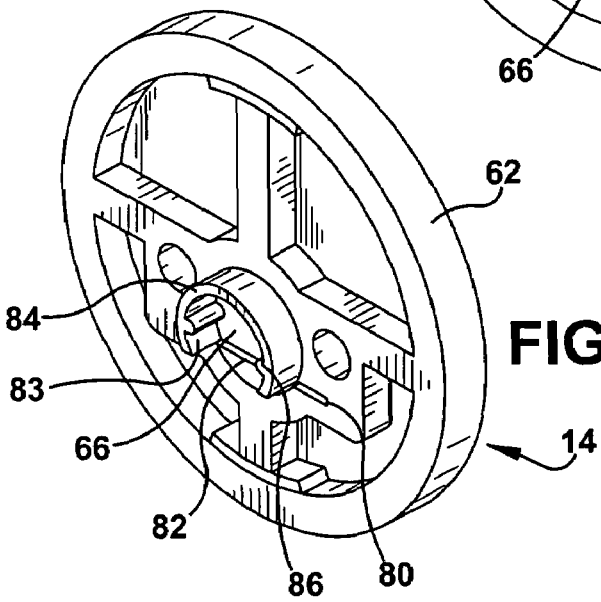
FIG. 9 is a perspective view of the mounting plate shown in FIG. 7.
Figure 11:
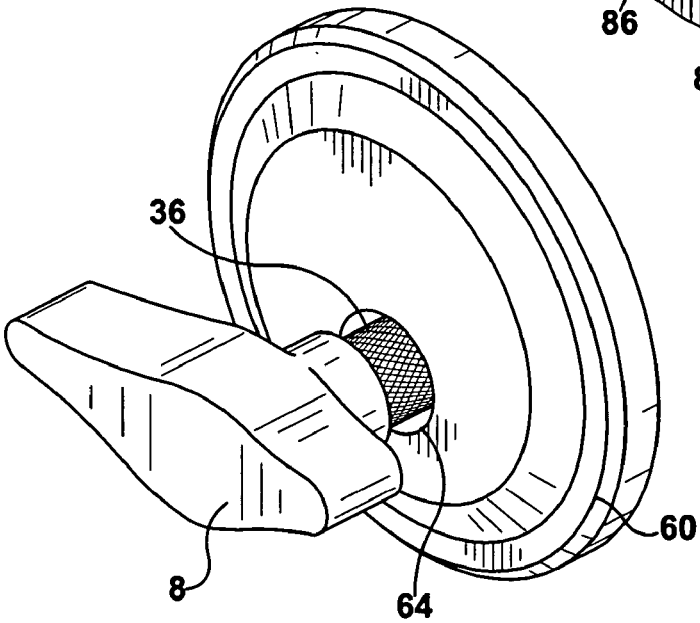
FIG. 11 is a front perspective view of the subassembly shown in FIG. 7 in the lock-out position.

Referring now to FIGS. 7-9 shaft housing 14 is described. Shaft housing 14 is comprised of an outer decorative plate 60 and a mounting plate 62. Both plates 60 and 62 have an opening 64 (as seen in FIG. 11) and 66, respectively, for accommodating shaft 10. Between plates 60 and 62 a signal disk is mounted and is recessed from the surface of decorative plate 60. Decorative plate 60 covers the exterior surface of mounting plate 62.

The interior or door facing side of mounting plate 62 includes a groove 80. Groove 80 holds a spring or detent device 82. Detent device 82 is a spring wire in the embodiment shown, but any type of known device that creates a spring, resilient or holding force can be used. The detent device 82 operates on cam surfaces 42 and 44 of shaft 10 as set forth below and serves to hold the shaft in, or urge it into, either a locked or unlocked position. The total shaft length can be of any dimension, but is preferably between 15 and 75 millimeters.

The mounting plate 62 also includes a collar 84 that extends from plate 62 around opening 66 except where biasing device 82 is located. In the embodiment shown in FIGS. 7-9, collar 84 is circular or semi-circular in shape, but any shape that corresponds to the shape of head portion 50 of shaft 10 can be used. Collar 84 also has two protrusions or protuberances 86 that extend from the inside walls 83 of collar 84. These protuberances 86 extend out from the wall of collar 84 approximately 2-3 millimeters to their tips and preferably can extend out from the inside walls of the collar anywhere from 1 millimeter to 2 centimeters. Protuberances 86 correspond to depressions 54 on the head portion 50 in shape and location, and, in this embodiment run parallel to the horizontal axis of shaft 10 when it is mounted in opening 66.

Figure 12:
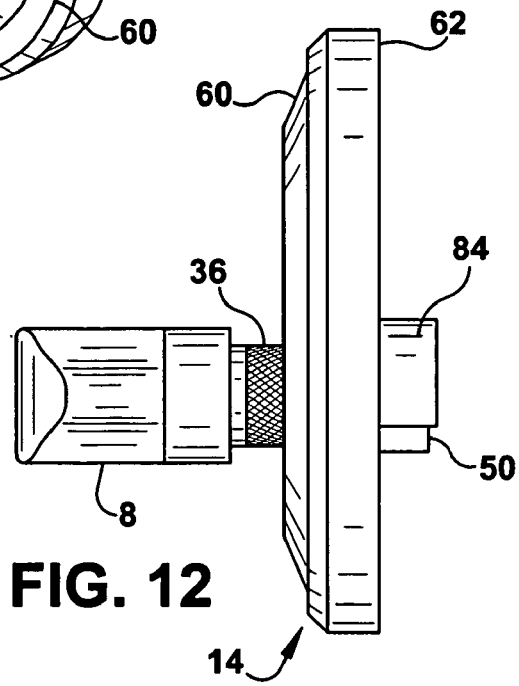
FIG. 12 is a side view of the subassembly shown in FIG. 7 in the lock-out position.
Figure 13:
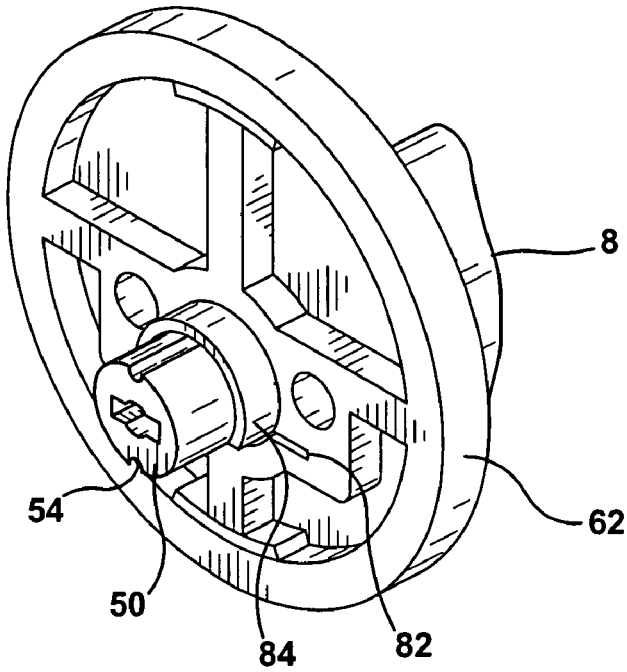
FIG. 13 is a rear perspective view of the subassembly shown in FIG. 7 in the operational deadbolt position.
Figure 14:
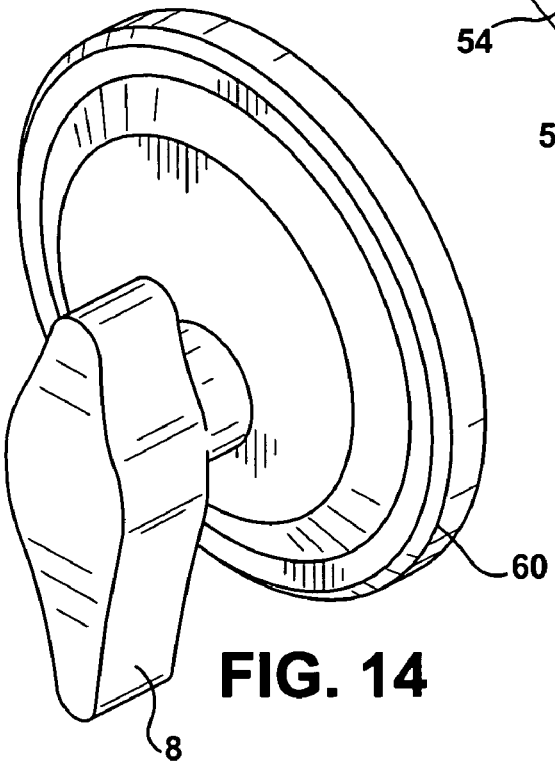
FIG. 14 is a front perspective view of the subassembly shown in FIG. 7 in the operational deadbolt position.
Figure 15:
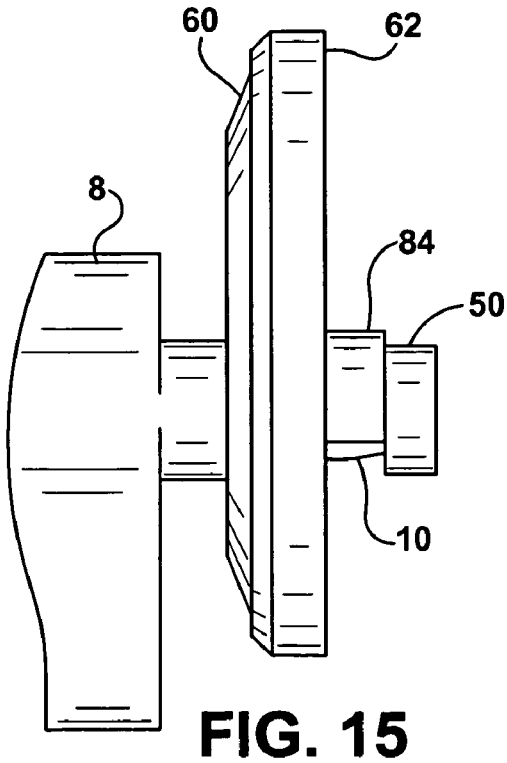
FIG. 15 is a side view of the subassembly shown in FIG. 7 in the operational deadbolt position.
Figure 16:
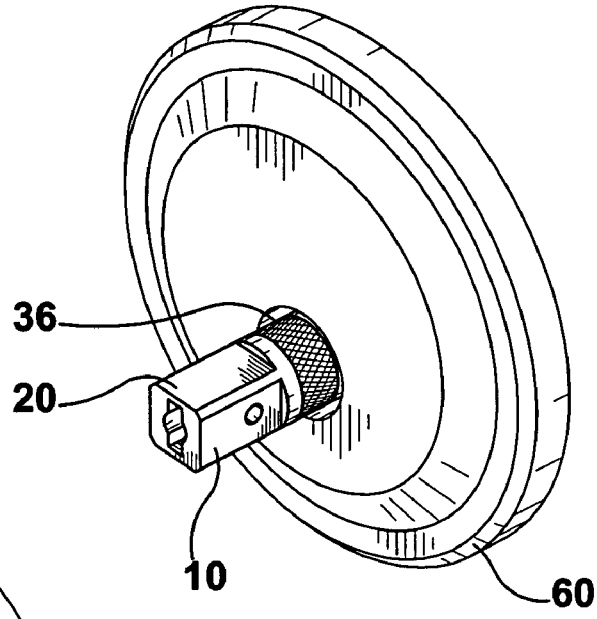
FIG. 16 is an assembly view of the mounting plate and shaft subassembly in the lock-out position.
Figure 17:
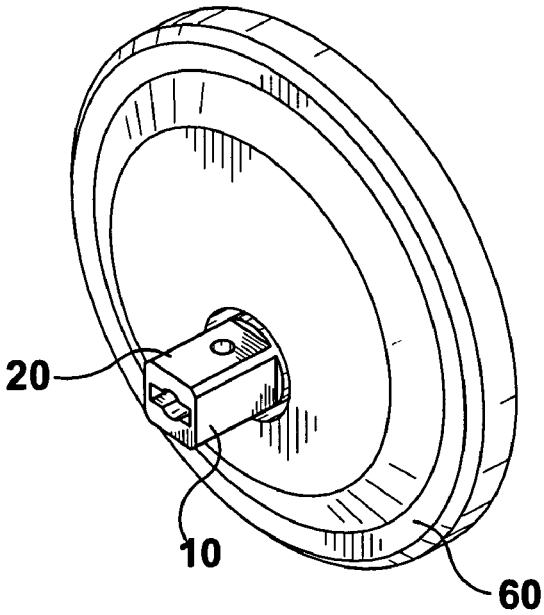
FIG. 17 is an assembly view of the mounting plate and shaft subassembly in the operational deadbolt position.
Figure 18:
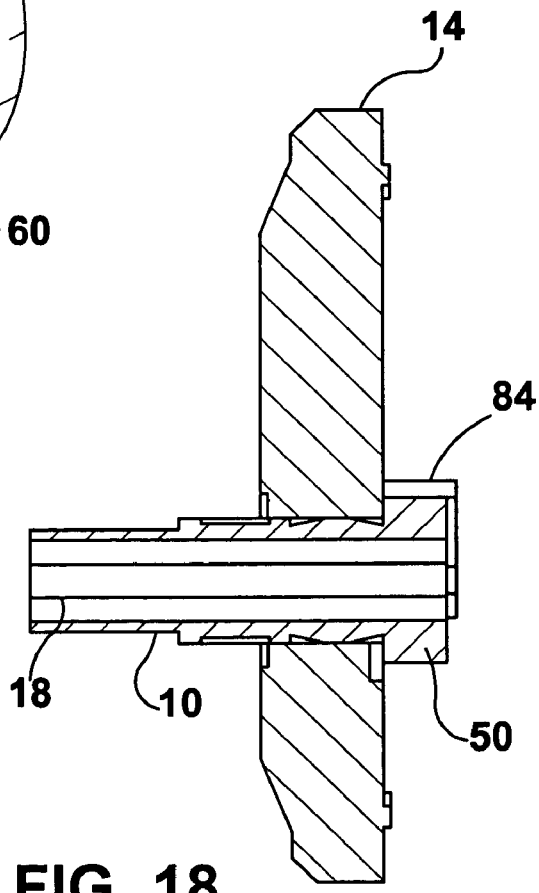
FIG. 18 is a cross-sectional view of the mounting plate and shaft subassembly in lock-out position.

Now referring to FIGS. 10-18, the operation of one embodiment of the invention is described. As shown in FIGS. 13-15, the deadbolt mechanism 3 is in an unlocked position. As can be seen, head portion 50 extends beyond collar 84. Thus, handle 8 can be rotated clockwise or counter clockwise to a locked position which would extend the deadbolt into a locked position. When handle 8 is rotated to the locked position, one of camming surfaces 46 operates against detent device 82 to "snap" the shaft 10 into the locked position.

Figure 10:
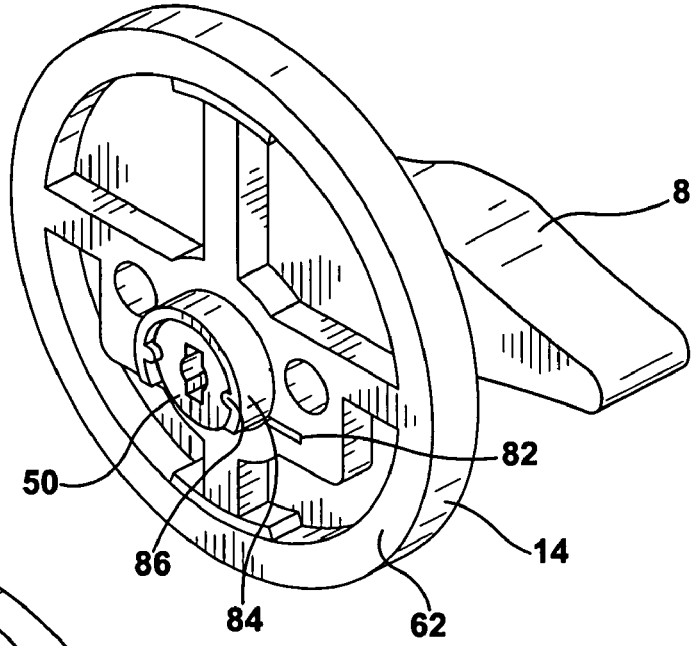
FIG. 10 is a rear perspective view of the subassembly shown in FIG. 7 in the lock-out position.

Referring now to FIGS. 10-12, the shaft 10 is shown in the locked position. As can be seen, the depressions 54 correspond to and are "keyed" to protuberances 86 in the locked position. In this position, the deadbolt is extended from the door into the locked position.

To operate the lock-out function the handle 8 is pulled outwardly from the door 2. This causes detent device 82 to act against camming surface 42 so that an adequate pulling force must be applied to handle 8 to overcome the spring or resilient force against the cam surface 42. This tends to prevent accidental operation of the lock-out function.

As shaft 10 is pulled out by handle 8, protuberances 86 fit into depressions 54 allowing the shaft 10 to continue to be pulled. When detent device 82 reaches the end of cam surface 42 it "snaps" or moves onto downward sloping cam surface 44, effectively, pushing the head portion 50 into full interlocking engagement with the collar 84, which is the lock-out position of the complete assembly.

In this lock-out position, as shown in FIGS. 11 and 12, the protuberances 86 and the depressions 54 are in an interlocking relationship such that the deadbolt can not be operated by key cylinder 4 and key 5. This is the result of member 16 being held stationary by engagement between the shaft 10 and housing 14. The engagement of the shaft 10 with the housing 14 is a result of the head portion 50 of the shaft nesting within the collar 84 of the housing 14 with the depressions 54 engaging the protuberances 86 on the collar.

In the lock-out position, the signal portion 30 of the shaft 10 and indication mechanism 36 becomes visible to the user indicating that the lock-out function is in operation and must be disengaged to operate the deadbolt.

To disengage the lock-out function, the user simply pushes on handle 8. The same "snapping" camming surface operation will occur when the pushing force overcomes the spring force of detent device 82 on camming surface 44. This will cause the lock-out function to disengage, thereby allowing handle 8 to be rotated which rotates member 16 and moves the deadbolt to the unlock position.

In an alternate embodiment, a person ordinarily skilled in the art would understand that the depressions 54 could be present in the collar 84 and the corresponding protuberances 86 could be present in the head portion 50. It should also be understood that deadbolt manipulation mechanisms are not limited simply to a key cylinder and handle, but may take the form of various mechanical devices. Neither is the invention limited to deadbolts or bolts, but can be used with any known locking mechanism.

Figure 19:
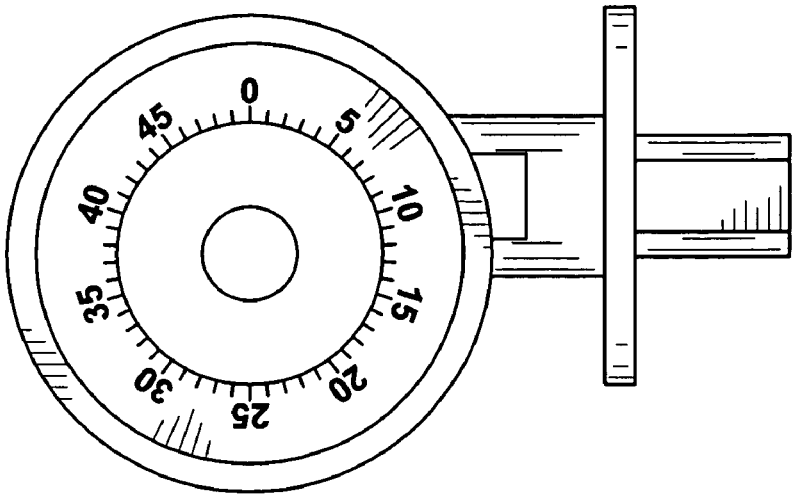
FIG. 19 illustrates a device for operating a locking device that can be operated through the use of a combination dial or a key cylinder.

The invention can be used with any mechanical device that can operate any locking mechanism, including a combination-type mechanical device or a device that can be operated by a combination dial or a key cylinder alternatively and interchangeably. In such a device, a user can operate a locking mechanism, including a deadbolt, by rotating a dial using an authorized numerical combination or by using the key cylinder. Such a device is depicted in FIG. 19.

Figure 20:
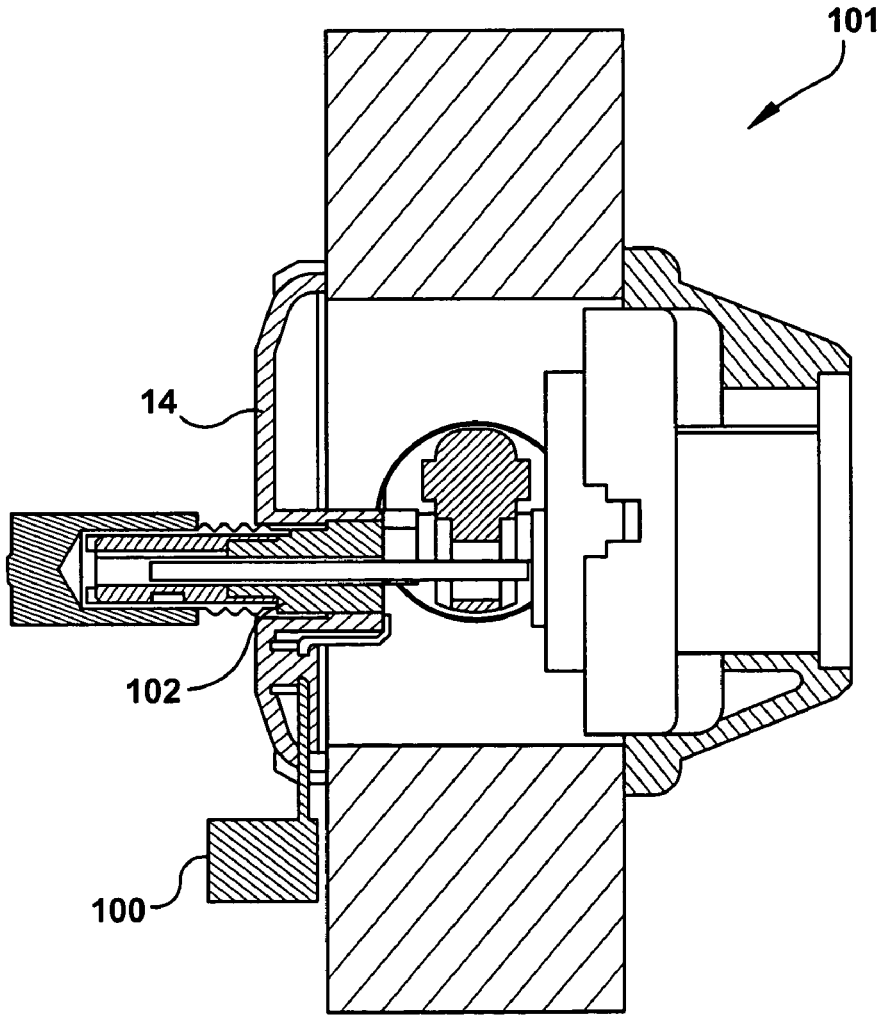
FIG. 20 is a partial cross-sectional view of the deadbolt lock-out mechanism that incorporates a release mechanism.

Referring to FIG. 20, an alternative embodiment is described. In this embodiment a further feature limits the possibility of inadvertently placing the device in a lock-out position. A release mechanism 100 is incorporated into a deadbolt mechanism 101. The release mechanism 100 enters the deadbolt mechanism 101 through the shaft housing 14 and is in direct or indirect contact with the shaft 102. As described above, the lock-out function can be either active (i.e. the shaft 102 is in a lock-out position and a key cylinder can not operate the deadbolt) or the lock-out function is inactive (i.e. the shaft 102 is not in a lock-out position and the deadbolt can be operated with a key cylinder). The shaft 102 can be placed in a lock-out position only when the release mechanism 100 is manually actuated, thus a user needs to use two hands, one to manipulate the release mechanism 100 and one to manipulate the knob or handle 8, in order to place the shaft 102 in a lock-out position. This added constraint decreases the likelihood that a user would inadvertently place the lock-out mechanism in an undesired state.

Although a user would need to use two hands to place the shaft 102 in a lock-out position, which activates the lock-out function, the user can deactivate the lock-out function by simply manipulating the knob or handle 8 with one hand. Typically, the lock-out function can be deactivated by pushing on the knob 8, which removes the shaft 102 from the lock-out position and allows the key cylinder to manipulate the deadbolt.

In an alternative embodiment, the user must actuate the release mechanism 100 to either activate or deactivate the lock-out function. A person skilled in the art would recognize that the release mechanisms 100, as described herein, are only exemplary illustrations. A number of variations will occur to those reading and understanding the description. It is intended that such variations be included in the specifications.

Figures 21, 21A:
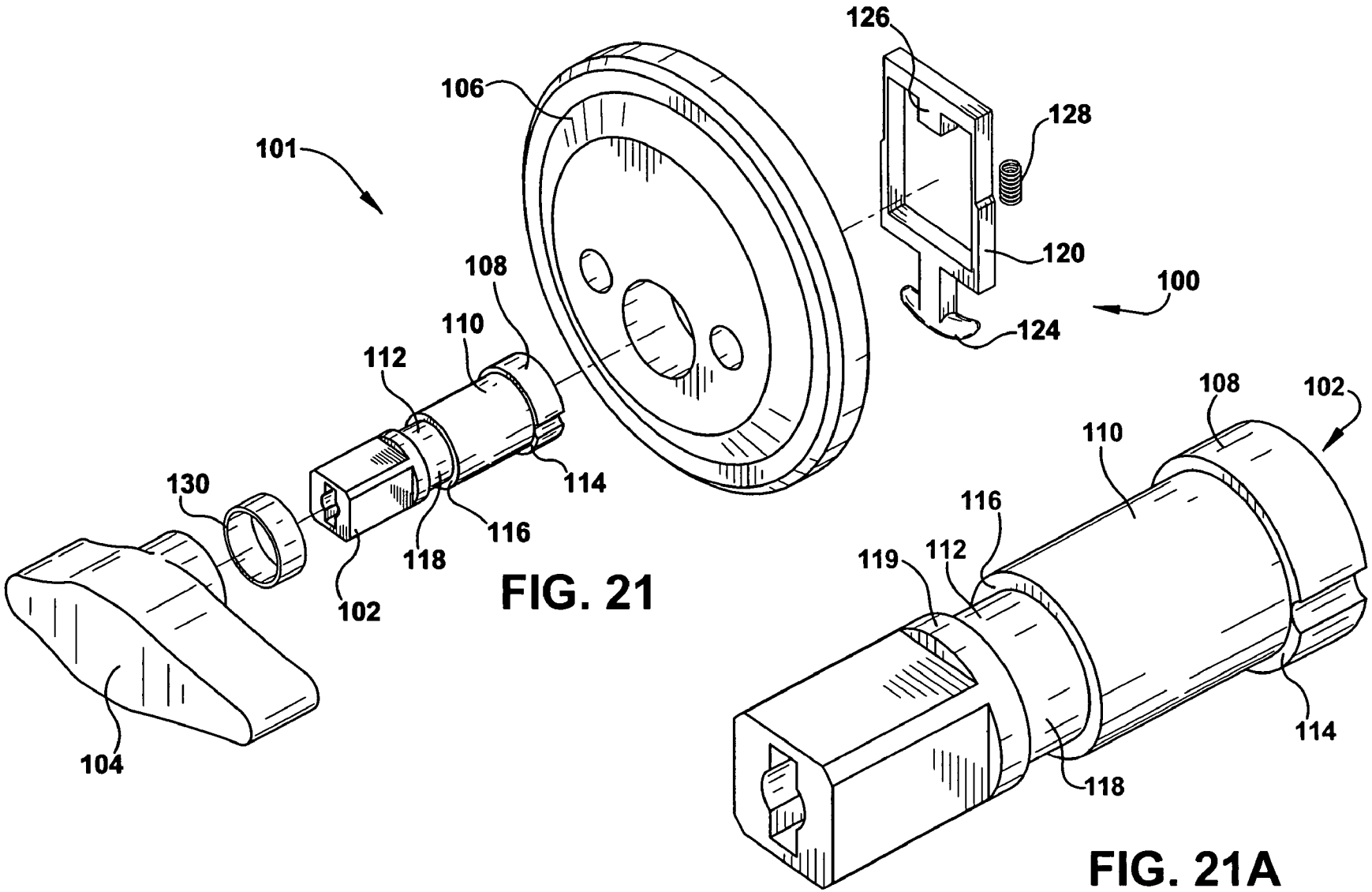
FIG. 21 is an exploded view of a deadbolt lock-out mechanism incorporating a release mechanism.
FIG. 21A is a detailed view of the shaft shown in FIG. 21.
Figure 22:
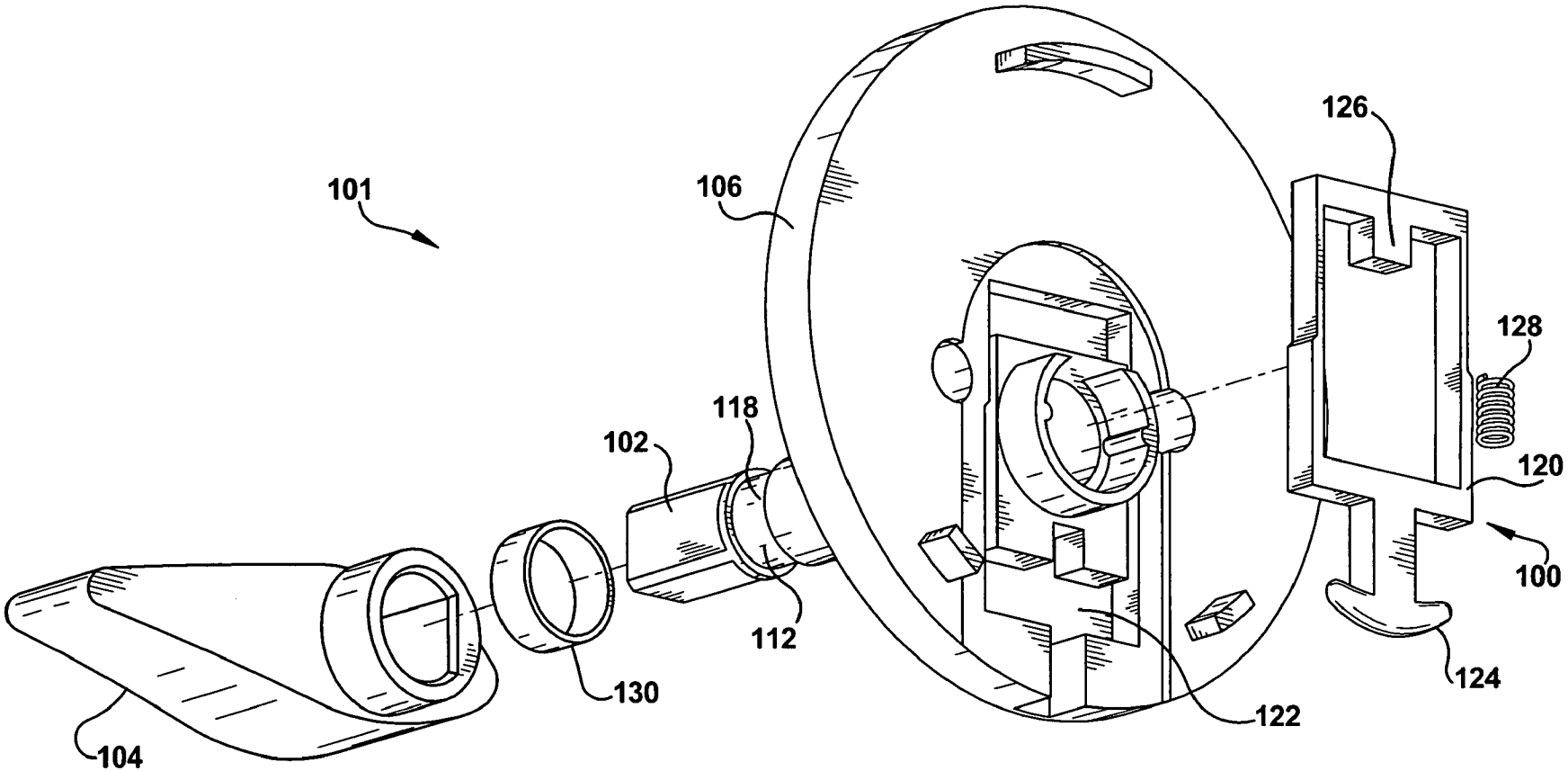
FIG. 22 is an exploded view of a deadbolt lock-out mechanism incorporating a release mechanism.
Figure 23:
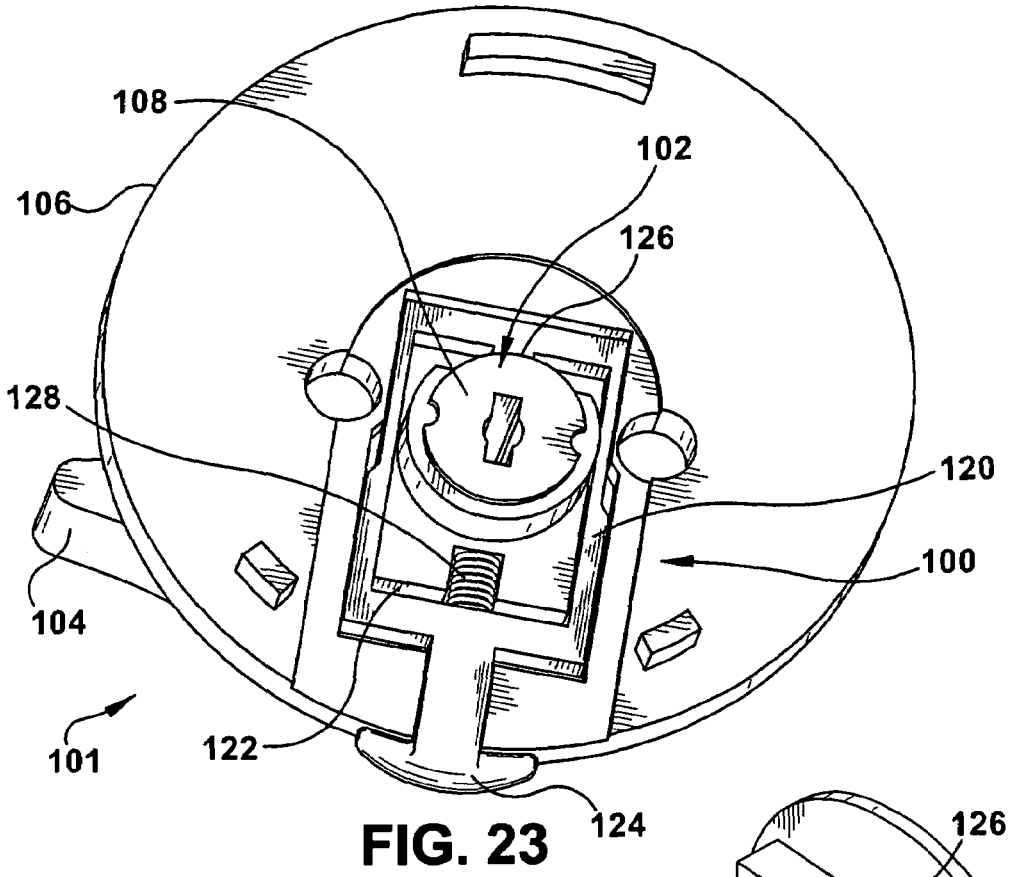
FIG. 23 is an perspective view of a deadbolt lock-out mechanism incorporating a release mechanism.

FIGS. 21-23 illustrate one embodiment of a release mechanism 100. FIGS. 21 and 22 are exploded views illustrating the various components of a deadbolt mechanism 101 incorporating a release mechanism 100. Similar to the description above for a deadbolt mechanism 3, a deadbolt mechanism 101 that incorporates a release mechanism 100 includes a shaft 102 that is mechanically coupled to the deadbolt (not shown) such that rotation of the shaft 102 operates the deadbolt. The shaft 102 can be rotated by either a key cylinder or a handle 104. Also as described above, the handle 104 can be pulled outward away from a mounting plate 106 to place the deadbolt in a lock-out position and prevent rotation of the shaft 102.

The shaft 102 includes a head portion 108, an intermediate portion 110, and a stop groove portion 112. In this embodiment, all three portions 108, 110, 112 of the shaft 102 are circular in cross-section; however, the shaft 102 is not limited to any particular cross-sectional shape. As best seen in FIGS. 21 and 21A, the head portion 108 is located on one end of the shaft 102. The intermediate portion 110 is located next to the head portion 108 and has a smaller diameter than the head portion 108. The stop groove portion 112 is located next to the intermediate portion 110 and positioned so that the intermediate portion 110 is between the stop groove portion 112 and the head portion 108. The diameter of the stop groove portion 112 is smaller than the diameter of the intermediate portion 110. The difference in diameter between the head portion 108 and the intermediate portion 110 forms a lock-out lip 114 at the transition point between head portion 108 and the intermediate portion 110. The difference in diameter of the intermediate portion 110 and the stop groove portion 112 forms an operational lip 116 at the transition point between the intermediate portion 110 and the stop groove portion 112. The stop groove portion 112 includes a groove or cavity 118. As best seen in FIGS. 21 and 21A, the groove 118 is generally a cutout portion that extends circumferentially around the shaft 102 and is bounded by the operational lip 116 on one side and another larger diameter 119 on the other side.

In the embodiment shown in FIGS. 21-23, a pin 120 is used as part of a release mechanism 100. As best shown in FIG. 23, the pin 120 is placed in a channel or opening 122 surrounding the head portion 108 of the shaft 102. The pin 120 includes a button 124 and a stop 126. A spring 128 is used to bias the pin 120 downward, such that the button 124 moves away from the shaft 102. The button 124 extends through the mounting plate 106 such that the button 124 can be manually manipulated to move or operate the pin 120. In this specific embodiment, the button 124 is used to move the pin 120 upward against the spring force. As described below, such movement will disengage the stop 126 from the shaft 102, thereby allowing the handle 104 to be pulled outward away from the mounting plate 106 to place the shaft in the lock-out position and prevent rotation of the shaft 102.

The stop 126 engages and disengages the shaft 102 along the groove 118. When the stop 126 is engaged to the groove 118 the lock-out function is inactive and the shaft 102 is free to rotate allowing the deadbolt to be locked and unlocked. When unopposed, the bias of spring 128 forces the stop 126 into engagement with the groove 118. When the button 124 is sufficiently pushed upward against the spring force, the stop 126 disengages the groove 118. As the button 124 is pushed upward, the stop 126 can be displaced enough to cause the bottom of the stop 126 to clear the operational lip 116. When the stop 126 is in this position, the shaft 102 can be pulled outward away from the mounting plate 106, which activates the lock-out function. As the shaft 102 is pulled outward from the mounting plate 106, the stop 126 can ride along the intermediate potion 110 of the shaft 102 until the stop comes into contact with the lock-out lip 114, which can restrains the shaft 102 from being pulled any farther away from the mounting plate 106. A visual signal, such as a colored band 130 can be placed on a portion of the shaft 102, to let users know when the deadbolt is inoperable. To deactivate the lock-out function, a user can push the handle 104 back towards the mounting plate 106. The stop 126 can ride along the intermediate portion 110 until it passes the operational lip 116 and reengages the groove 118. In this position the deadbolt becomes operable and the key cylinder or handle 104 is capable of operating the deadbolt.

Figure 24:
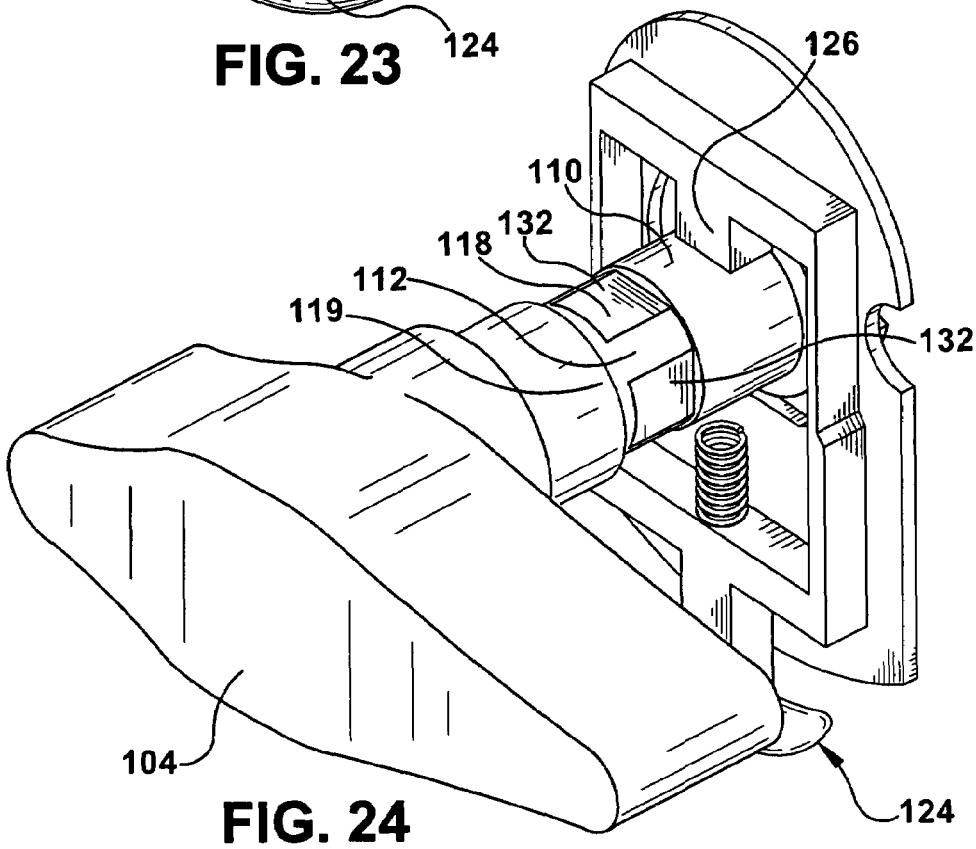
FIG. 24 is an perspective view of a release mechanism for a deadbolt lock with flats on the shaft.
Figure 26:
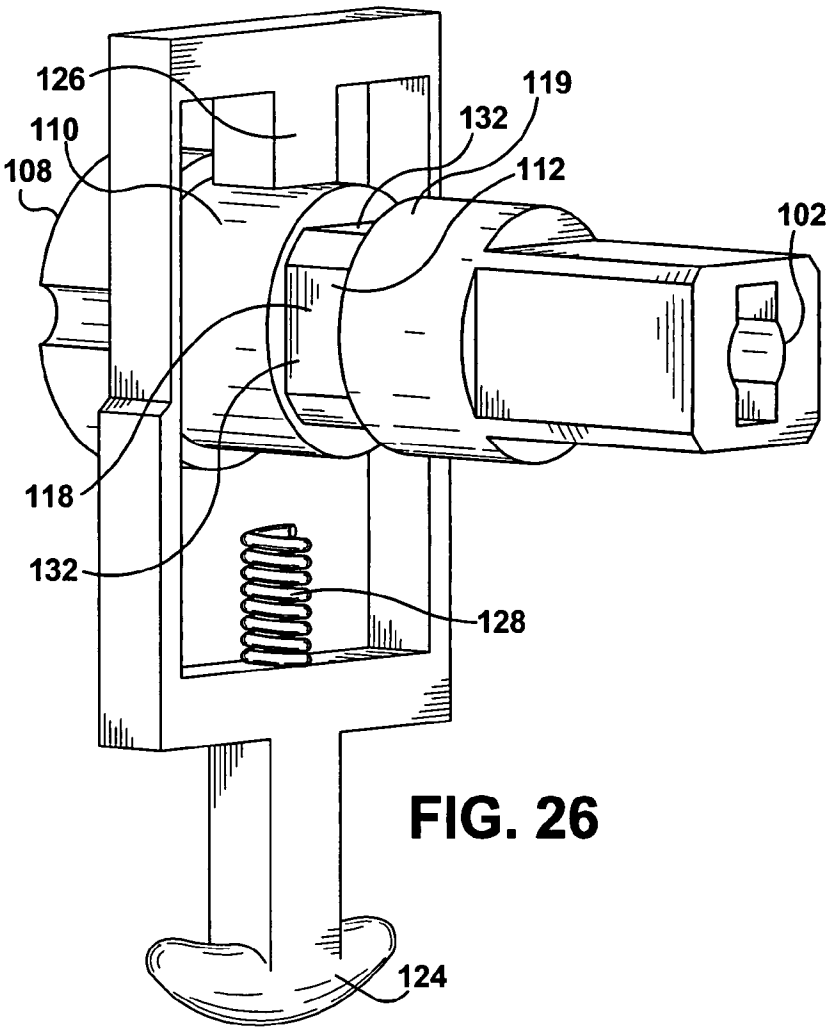
FIG. 26 is an perspective view of a release mechanism for a deadbolt lock with flats on the shaft.
Figure 25:
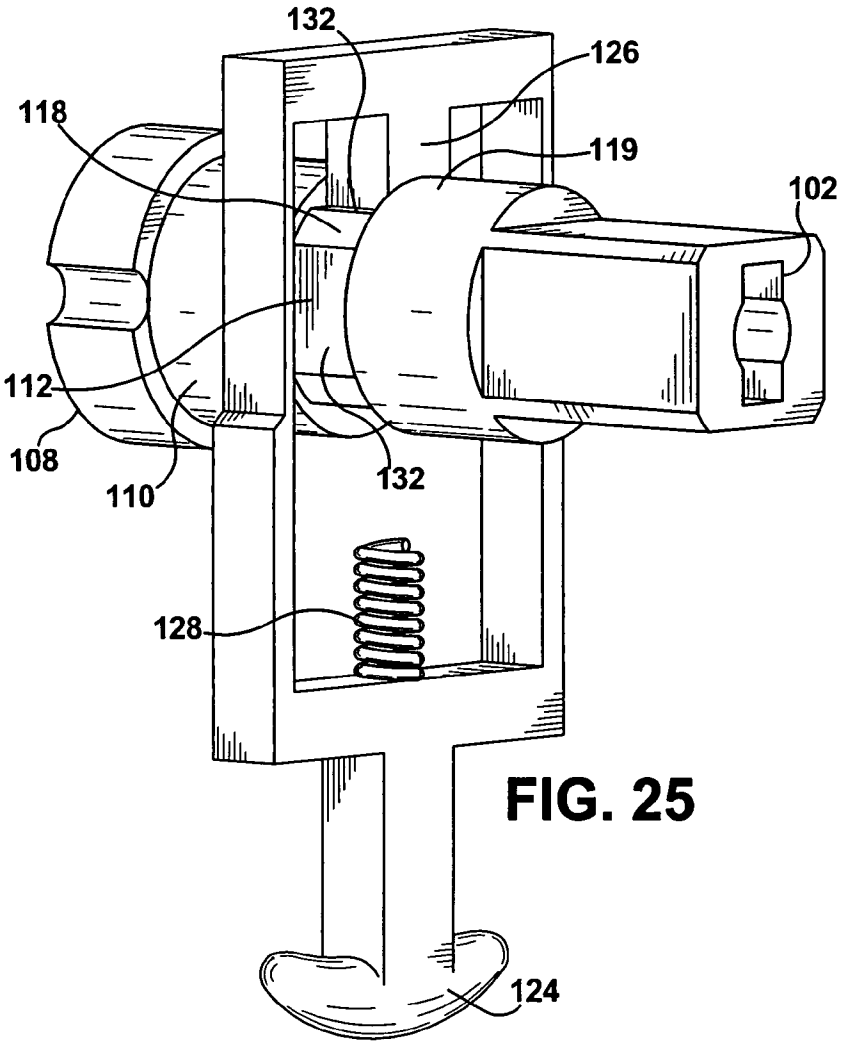
FIG. 25 is an perspective view of a release mechanism for a deadbolt lock with flats on the shaft.

In another embodiment, as seen in FIGS. 24-26, the groove 118 is comprised of four flats 132 positioned ninety degrees apart from each other. When the lock-out function is inactive and the stop 126 is engaged with the groove 118, the handle 104, as it is turned, can be positioned in ninety degree increments. The flats 132 interact with the stop 126 to create these ninety degree increments. Each increment positions the deadbolt either in fully extended or a fully retracted position.

In another embodiment, the shaft 102 includes a second groove (not shown) such that the stop 126 coincides with the second groove when the lock-out function is activated. In this embodiment, the release mechanism 100 must be actuated to move the shaft 102 from the lock-out position to a position where the deadbolt is operable.

The release mechanism 100 can be achieved with a number of different embodiments. FIGS. 27-37 illustrate only some of the many additional embodiments.

Figure 27:
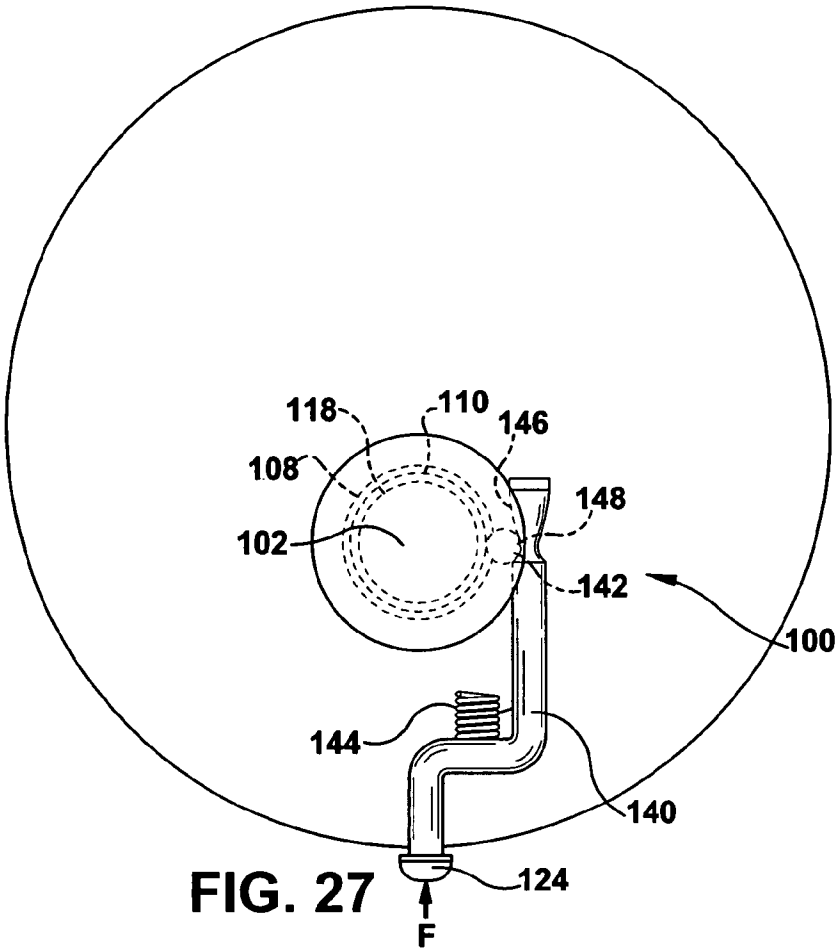
FIG. 27 is a schematic view of a release mechanism for a deadbolt lock.

FIG. 27 shows a release mechanism 100 comprising a bent pin 140, a button 124 attached to the bent pin 140, a ball 142 in contact with the bent pin 140, and a spring 144 in contact with the bent pin 140. In this embodiment, when a force F is applied to the button 124 the bent pin 140 moves upward and disengages the release mechanism 100 from the groove 118 and allows the shaft 102 to move axially into a lock-out position. The bent pin 140 is biased downward by the spring 144. When the spring 144 biases the bent pin 140 downward to its lowest position (not shown in FIG. 27), the ball 142 is wedged into the groove 118 by an inclined section 146 on the bent pin 140. When the bent pin 140 travels upward to its highest position, due to a force F placed on the button 124, the ball will fall down the inclined section 146 due to gravity and settle in a facet 148 on the bent pin 140. This moves the ball away and out of the groove 118 and past the outer diameter of the intermediate portion 110 (shown by dashed line), thereby releasing the ball 142 from the groove 118 and allowing the shaft 102 to move axially into a lock-out position.

Figure 28:
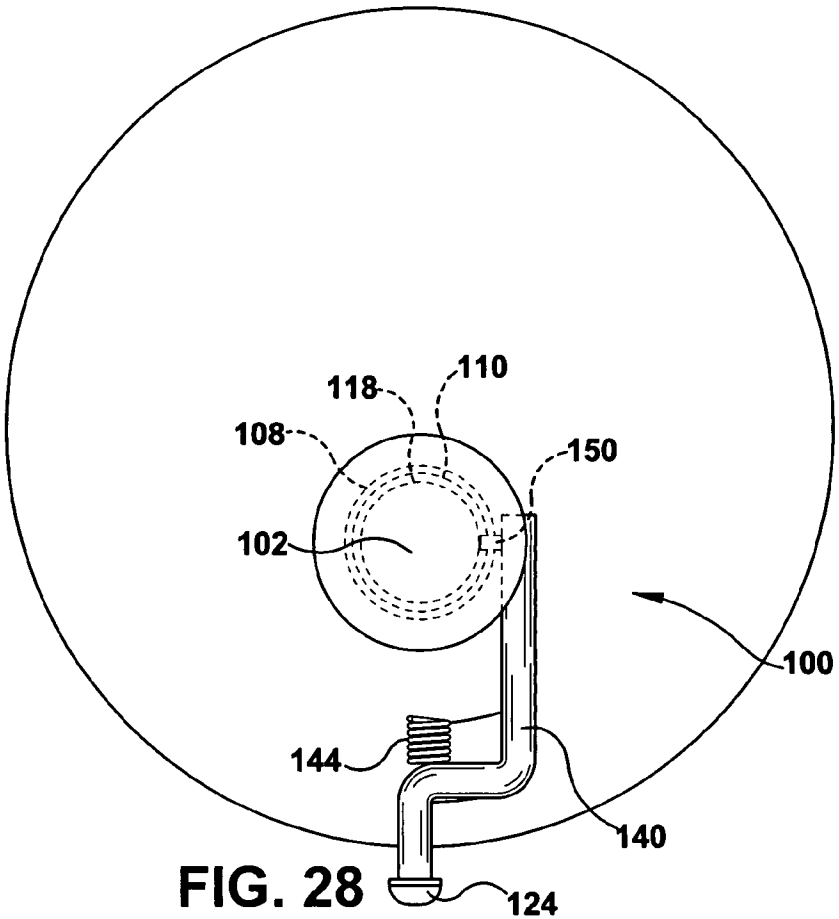
FIG. 28 is a schematic view of a release mechanism for a deadbolt lock.

In FIG. 28, the ball of FIG. 27 is replaced with a small protrusion or pin 150, which is secured to the bent pin 140. The protrusion 150 acts as a stop when engaged with the groove 118. As in FIG. 27, the bent pin 140 is biased downward by a spring 144. As a force is applied to the button 124 and the button 124 moves upward, the protrusion 150 will move upward, past the outer diameter of the intermediate portion 110 and out of the groove 118 in the shaft 102. This will release the shaft 102 to be moved into a lock-out position.

Figure 30:
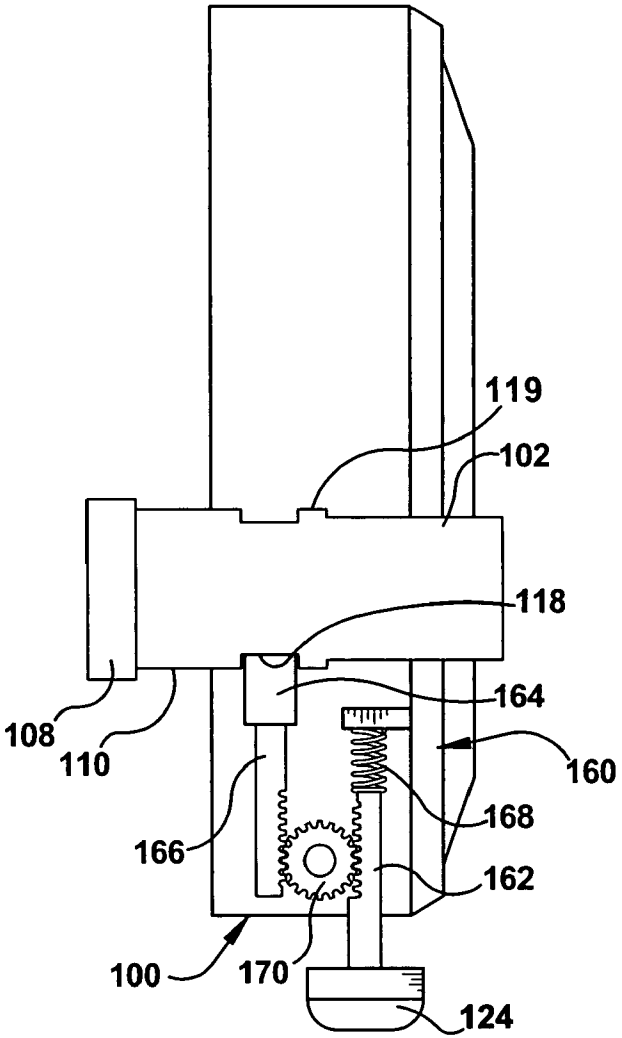
FIG. 30 is a schematic view of a release mechanism for a deadbolt lock.
Figure 29:
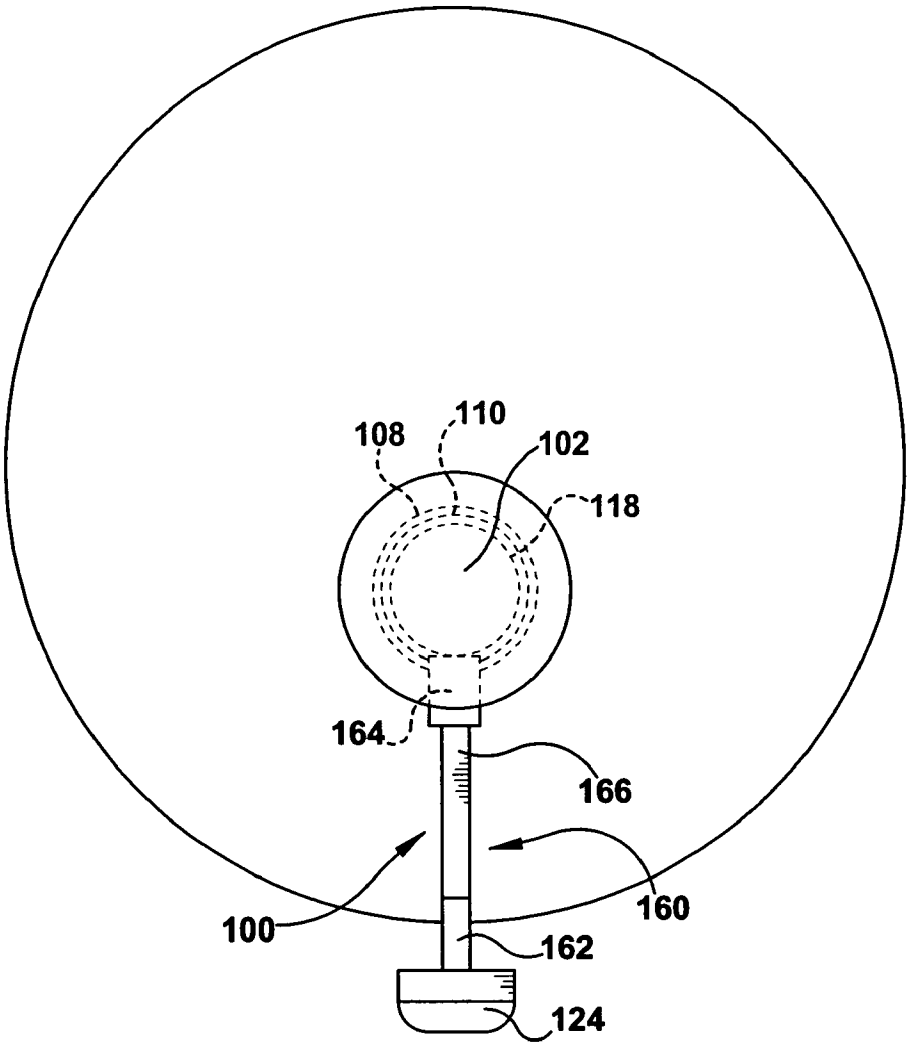
FIG. 29 is a schematic view of a release mechanism for a deadbolt lock.

In FIGS. 29 and 30, a rack and pinion mechanism 160 is used to alternatively restrict and allow axial movement of the shaft 102. This embodiment includes a button 124 attached to a button rack 162, a stop 164 attached to a stop rack 166, and a pinion 170 in contact with both racks 162, 166. The button rack 162 is biased or tensioned downward by a spring 168. When the button 124 is pushed upward, the button rack 162 moves upward thereby driving a pinion 170. The rotation of the pinion 170 moves the stop rack 166 downward, which moves the stop 164 out of the groove 118 in the shaft 102. When the stop 164 is moved past the outer diameter of the intermediate portion 110, the shaft 102 is released from the stop 164. Although FIG. 30 shows the spring 168 biasing the button rack 162, it should be understood that a spring could also be positioned to bias the stop rack 164 upward, or a number of other spring or biasing configurations can be used to hold the stop 164 in the groove 118 when the release mechanism 100 is not actuated.

Figure 31:
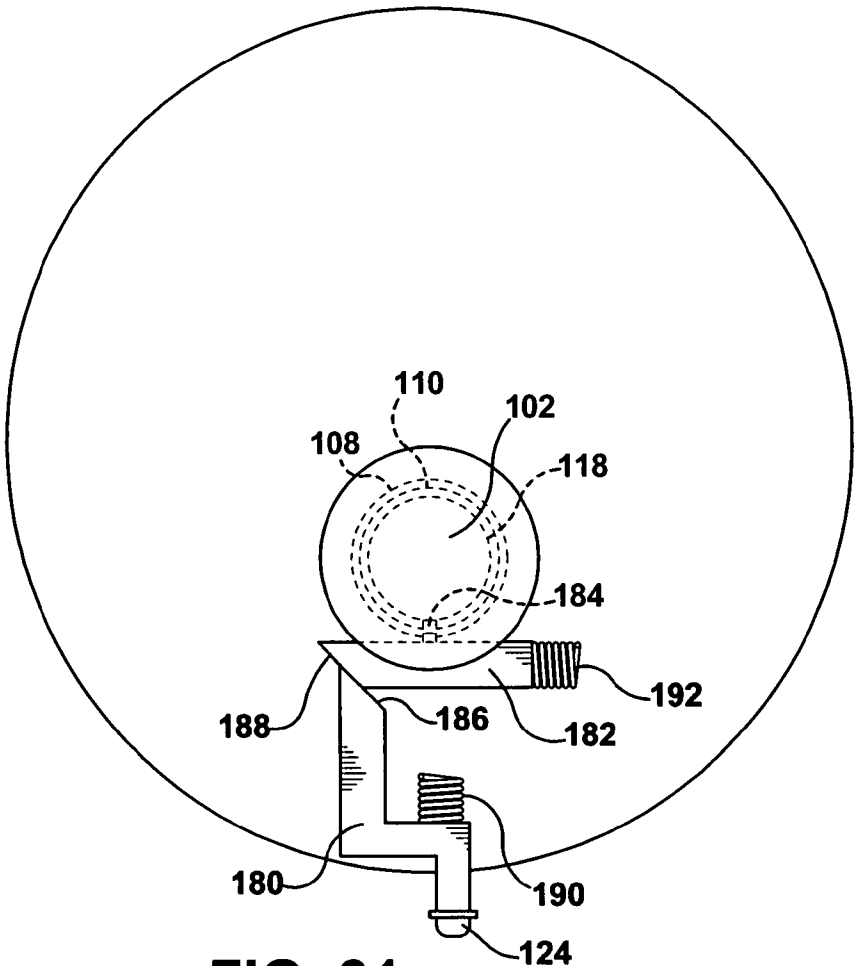
FIG. 31 is a schematic view of a release mechanism for a deadbolt lock.

The mechanism of FIG. 31 includes a button 124, a bent pin 180, a straight pin 182, and a protrusion 184. The protrusion 184 is secured to the straight pin 182 and acts as a stop. The button 124 is attached to the bent pin 180. Both the bent and straight pins 180, 182 include inclined surfaces 186, 188 and are biased by springs 190, 192. The biasing of the springs 190, 192 results in a force that moves the bent pin 180 downward. When the button 124 is pressed upward, the bent pin 180 moves upward and transfers motion to the straight pin 182 through the inclined plane 186 of the bent pin 180 sliding along the inclined plane 188 of the straight pin 182. As the protrusion 184 travels along with the straight pin 182 it will move out of the groove 118 in the shaft 102. When the protrusion 184 moves past the outer diameter of the intermediate portion 110 of the shaft 102, the shaft 102 is free to move and can be placed in a lock-out position.

Figure 32:
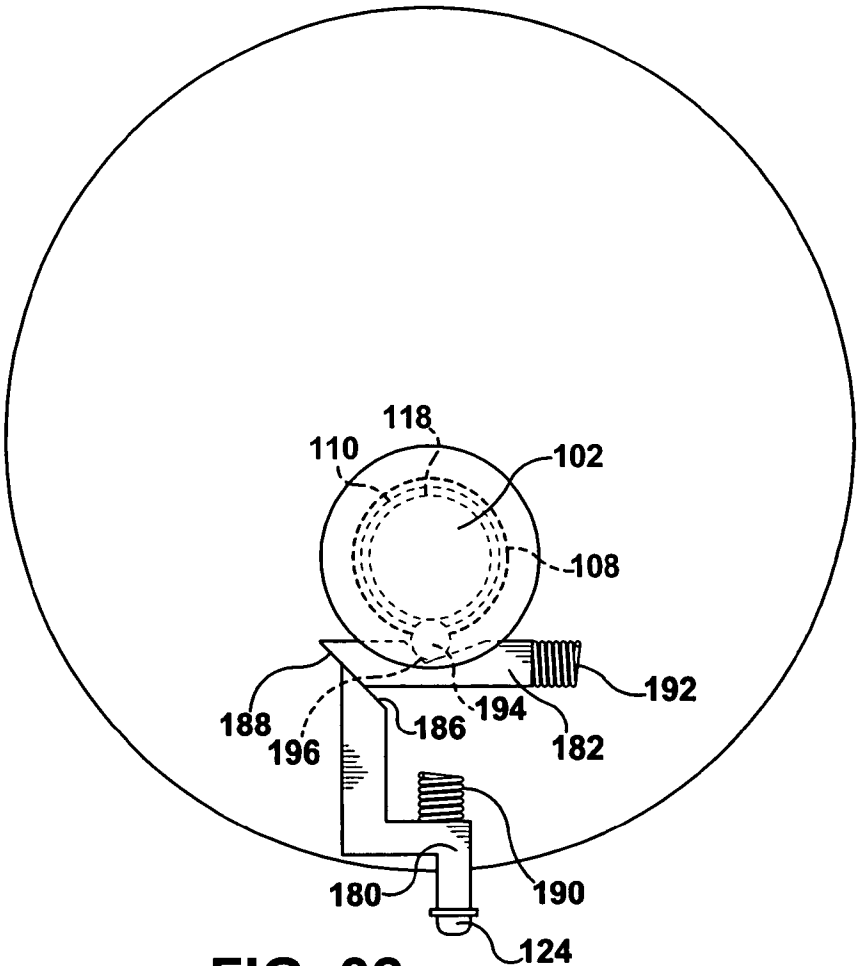
FIG. 32 is a schematic view of a release mechanism for a deadbolt lock.

The mechanism shown in FIG. 32 operates in a similar manner as the mechanism of FIG. 31. However, a ball 194 and inclined plane facet or recession 196 replace the protrusion 184. When the bent pin 180 is moved upward, the straight pin 182 moves the ball out of the groove 118, allowing for the shaft 102 to be moved into a lock-out position.

Figure 33:
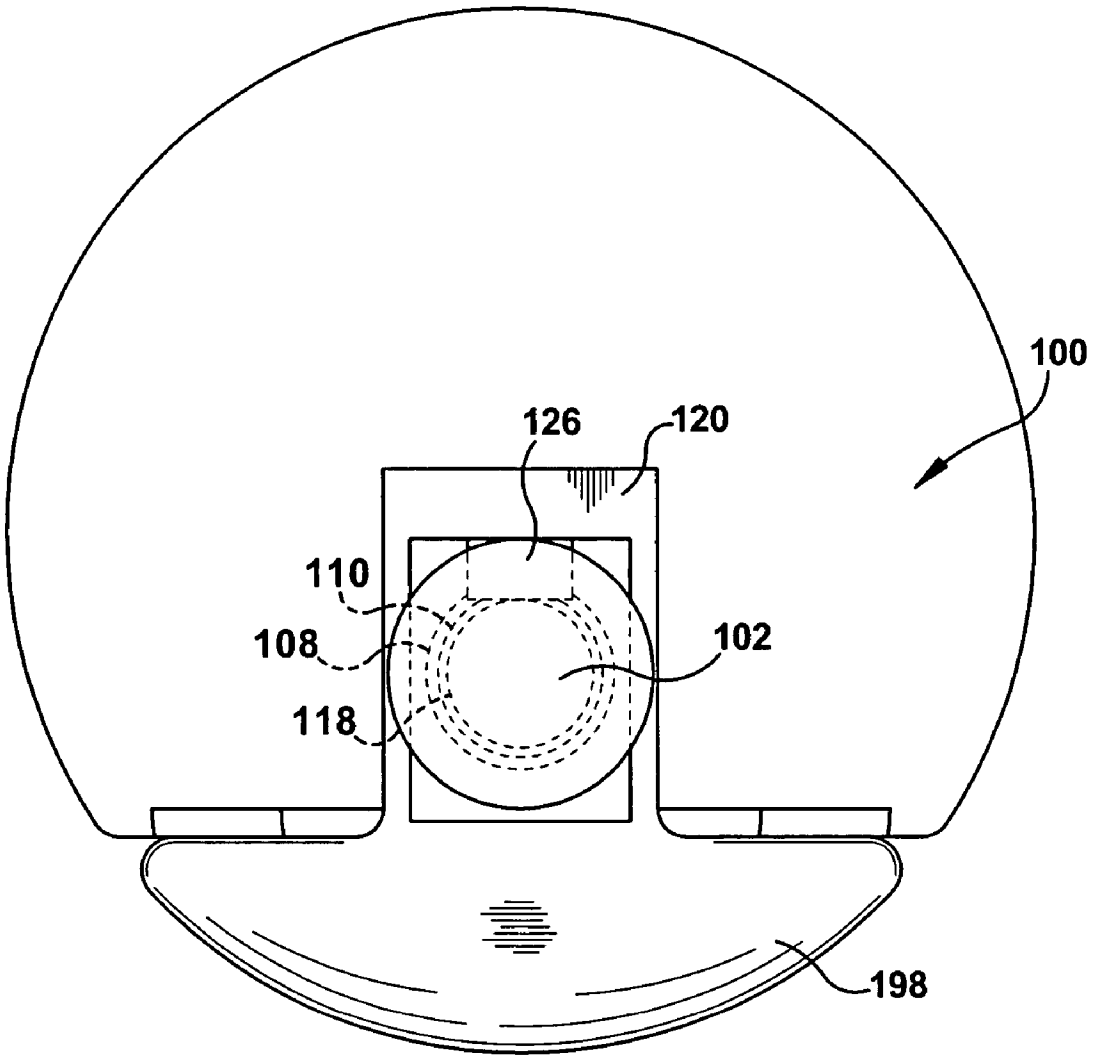
FIG. 33 is a schematic view of a release mechanism for a deadbolt lock.

The mechanism shown in FIG. 33 operates in a similar manner as the mechanism described in FIGS. 21-23. In this embodiment, the size of the button 198 has been increased to allow for easier operation or the release mechanism 100. The size of the button 198, which is increased to the size of a handle that fits inside a hand, can provide a blunt engagement surface that may allow the user to more easily use the palm of the hand to place force on the button 198. FIG. 33 illustrates the flexibility of modifying the button and insert to support the release mechanism 100. A handle can be used in place of a button in any embodiment herein described.

Figure 35:
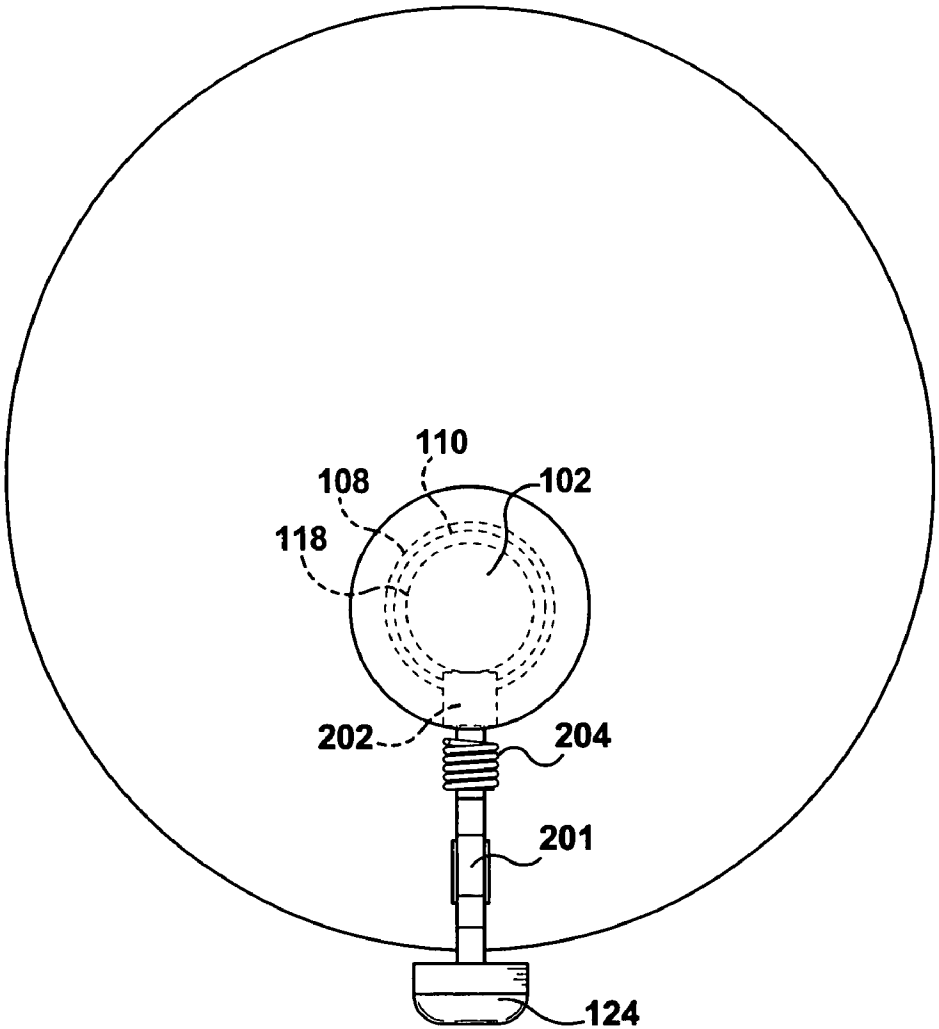
FIG. 35 is a schematic view of a release mechanism for a deadbolt lock.
Figure 34:
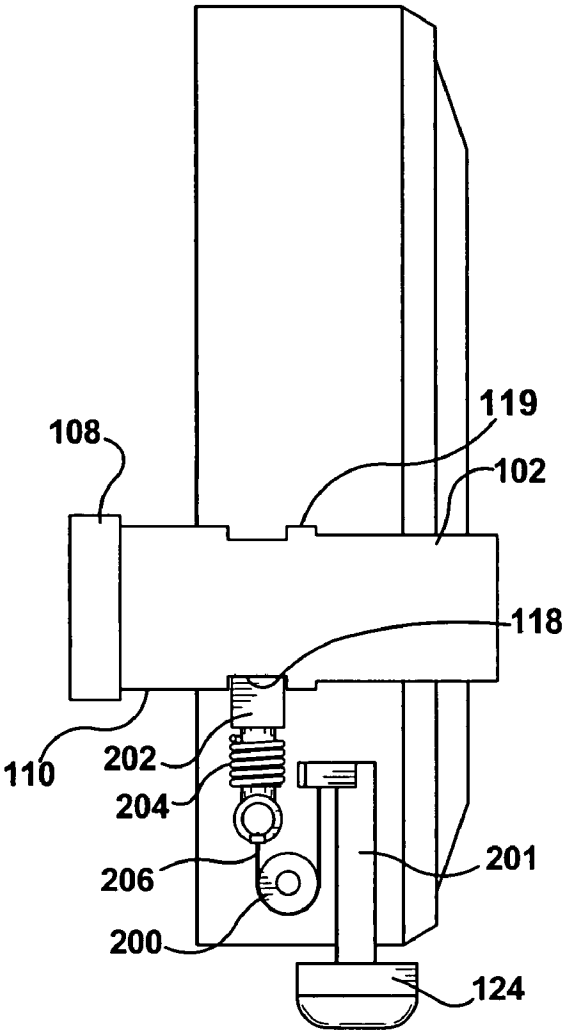
FIG. 34 is a schematic view of a release mechanism for a deadbolt lock.

In FIGS. 34 and 35, a pulley 200, a button 124, a button pin 201, a stop 202, a spring 204, and a high strength string or wire 206 (e.g. 20 lb test fishing line) are used to activate and inactive axial movement of the shaft 102. The button 124 is attached to the button pin 201, which is attached to the wire 206. The wire rides along the pulley 200 and is attached to the stop 202. The spring 204 biases the stop upward and into the groove 118. As the button 124 is pushed upward, the line 206 transfers the motion around the pulley 200 to pull the stop 202 downward. As the stop 202 travels downward and out of the groove 118 of the shaft 102, the shaft 102 is released and is free to be moved into a lock-out position.

Figure 36:
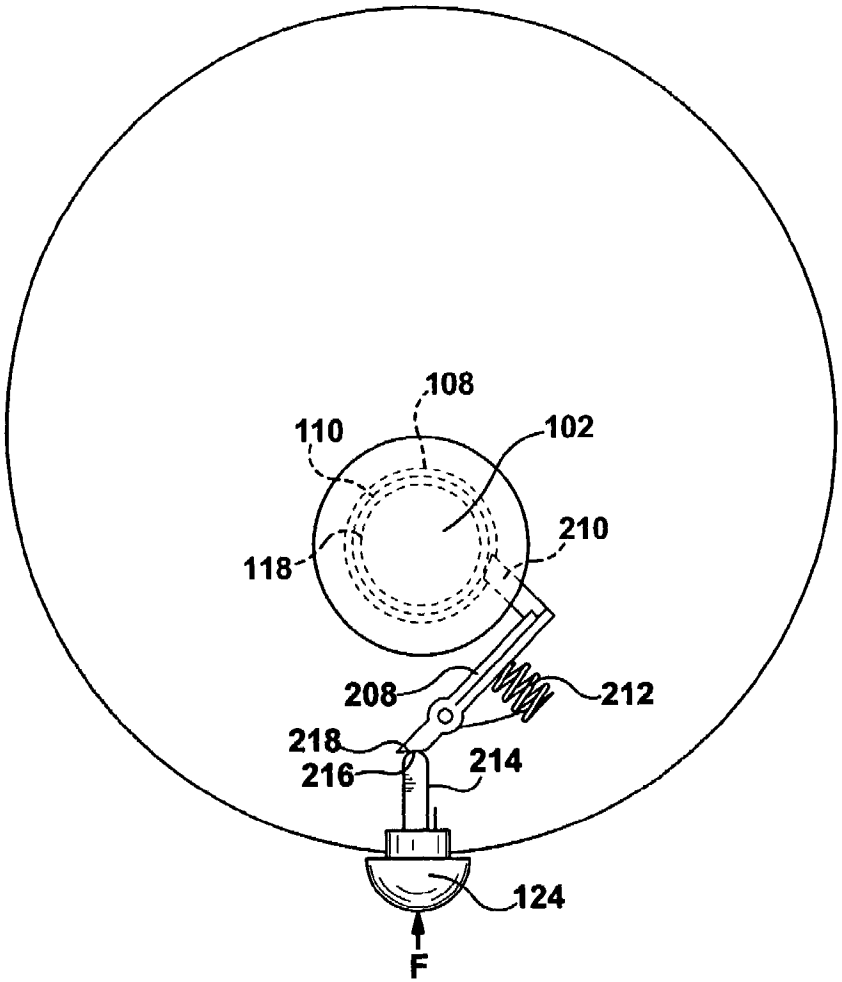
FIG. 36 is a schematic view of a release mechanism for a deadbolt lock.

In FIG. 36, a button 124, a lever 208 with a stop 210, and a spring 212 are used to activate axial movement of the shaft 102. The button 124 is attached to a button pin 214, which has a rounded end 216 for contacting the lever 208. The lever end 218 has a radius to receive the rounded end 216 of a button pin 214. A spring biases the lever 208 towards the shaft and when unopposed, moves the stop 210 into the groove 118. When the button 124 is moved upward by a force F, as shown in FIG. 36, the lever 208 will rotate and the stop 210 will move out of the groove 118. When the stop 210 has moved past the outer diameter of the intermediate portion 110 (as seen in FIG. 36), the shaft 102 is free to be moved into a lock-out position.

Figure 37:
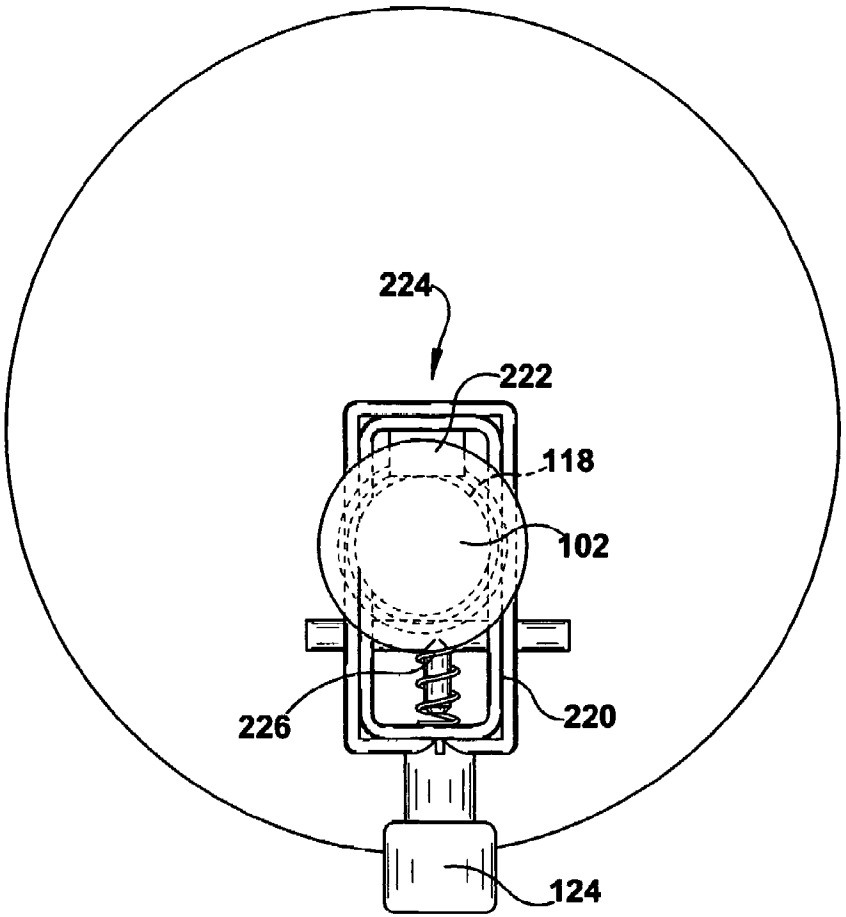
FIG. 37 is a schematic view of a release mechanism for a deadbolt lock.

In FIG. 37, a button 124, pin 220, stop 222, and spring detent 226 are integrated as a single piece or sub-assembly 224. When the button 124 is moved upward, that motion is transferred such that the stop 222 is released from engagement with the groove 118 in the shaft 102. Once the stop 222 is disengaged from the groove 118 in the shaft 102, the shaft 102 may be moved axially and into a lock-out position.

The invention has been described with reference to the preferred embodiment. Clearly, modifications and alterations will occur to others upon a reading and understanding of this specification. It is intended to include all such modifications and alterations insofar as they come within the scope of the appended claims or the equivalents thereof.

We claim:

1. A lock-out indicating mechanism for a deadbolt lock comprising:

a. a shaft axially movable from a rotatable position to a non-rotatable position, the shaft including a groove; and b. a release mechanism comprising:

i. a pin comprising:

1. a stop selectively engageable with a lip of the groove when the shaft is in the rotatable position, the lip being shaped to prevent axial movement of the shaft to the non-rotatable position in response to an axial force applied to the shaft, the groove being configured to permit rotation of the shaft when the stop is engaged with the groove; and 2. a button configured to disengage the stop from the groove when a force is applied to the button; and ii. a spring configured to bias the pin to engage the stop with the groove; wherein, when the stop is disengaged from the groove, the shaft is axially movable from the rotatable position to the non-rotatable position.

2. The lock-out indicating mechanism of claim 1, wherein when the stop is disengaged from the groove, the shaft is axially movable to place a deadbolt in a lock-out condition.

3. The lock-out indicating mechanism of claim 2, further comprising an indication mechanism located on the shaft for indicating when the deadbolt lock is in the lock-out condition.

4. The lock-out indicating mechanism of claim 3, wherein the indication mechanism comprises a colored ring.

5. The lock-out indicating mechanism of claim 3, wherein the indication mechanism comprises a colored section of the shaft.

6. The lock-out indicating mechanism of claim 1, where the buff on comprises a handle.

7. A lock-out indicating mechanism for a deadbolt lock comprising:

a. a shaft axially movable between a rotatable position and a non-rotatable position, the shaft including a groove along at least a portion of a circumference of the shaft; and b. a release mechanism, the release mechanism including an engagement member selectively engageable with the groove when the shaft is in the rotatable position, the groove being configured to permit rotation of the shaft when the engagement member is engaged with the groove;

wherein engagement of the engagement member with a lip of the groove prevents axial movement of the shaft to the non-rotatable position in response to an axial force applied to the shaft;

further wherein the release mechanism is configured such that a force applied to the release mechanism disengages the engagement member from the groove to permit axial movement of the shaft to the non-rotatable position.

8. The lock-out indicating mechanism of claim 7, wherein when the engagement member is disengaged from the groove, the shaft is axially movable to place a deadbolt into a lock-out condition.

9. The lock-out indicating mechanism of claim 7, wherein the release mechanism is operable to disengage the engagement member from the groove.

10. The lock-out indicating mechanism of claim 9, wherein the release mechanism is manually operable.

11. The lock-out indicating mechanism of claim 7, wherein the release mechanism further comprises:

a. a button coupled to the engagement member and configured to move the engagement member out of engagement with the groove when a force is applied to the button; and b. a spring, for biasing the engagement member towards engagement with the groove;

wherein, when the engagement member is moved out of engagement with the groove, the shaft is axially movable.

* * * * *